US011253083B2

(12) United States Patent
Pena et al.

(10) Patent No.: US 11,253,083 B2
(45) **Date of Patent: *Feb. 22, 2022**

(54) PRODUCT DISPLAY PUSHER SYSTEM

(71) Applicant: TracFone Wireless, Inc., Miami, FL (US)

(72) Inventors: Elvis Pena, Miami, FL (US); Edith Wollin, Miami, FL (US); Maria Echevarria, Miami, FL (US)

(73) Assignee: TracFone Wireless, Inc., Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/036,151

(22) Filed: Sep. 29, 2020

(65) Prior Publication Data

US 2021/0007511 A1 Jan. 14, 2021

Related U.S. Application Data

(63) Continuation of application No. 15/964,792, filed on Apr. 27, 2018, now Pat. No. 10,786,093.

(60) Provisional application No. 62/491,460, filed on Apr. 28, 2017.

(51) Int. Cl.
*A47F 1/12* (2006.01)
*A47F 5/00* (2006.01)

(52) U.S. Cl.
CPC ..... *A47F 1/126* (2013.01); *A47F 1/125* (2013.01); *A47F 5/005* (2013.01)

(58) Field of Classification Search
CPC .. A47F 1/126; A47F 1/125; A47F 1/12; A47F 5/005; A47F 5/0025
See application file for complete search history.

(56) References Cited

U.S. PATENT DOCUMENTS

| | | | |
|---|---|---|---|
| 5,012,936 | A | 5/1991 | Crum |
| 5,111,942 | A | 5/1992 | Bernardin |
| 5,123,546 | A | 6/1992 | Crum |
| 5,240,126 | A | 8/1993 | Foster et al. |
| 5,366,099 | A | 11/1994 | Schmid |
| 5,542,552 | A | 8/1996 | Yablans et al. |
| 5,562,217 | A | 10/1996 | Salveson et al. |
| 5,665,304 | A | 9/1997 | Heinen et al. |
| 5,855,281 | A | 1/1999 | Rabas |
| 5,855,283 | A | 1/1999 | Johnson |
| 6,105,791 | A | 8/2000 | Chaison et al. |
| 6,142,317 | A | 11/2000 | Meri |
| 6,464,089 | B1 | 10/2002 | Rankin, VI |
| 6,484,891 | B2 | 11/2002 | Burke |
| D472,411 | S | 4/2003 | Burke |

(Continued)

*Primary Examiner* — Kimberley S Wright
(74) *Attorney, Agent, or Firm* — Baker Hostetler

(57) ABSTRACT

A pusher tray assembly configured to hold product includes a pusher tray including a floor configured to hold the product thereon. The pusher tray including a front wall, at least one sidewall, and at least one back wall. The assembly further includes a pusher paddle having a front face and a back face, a plurality of engagement mechanisms arranged on a lower side of the pusher paddle and configured to secure the pusher paddle to the floor, a plurality of channels arranged in the floor and configured to receive the plurality of engagement mechanisms, and a spring configured to urge the pusher paddle towards the front wall. The plurality of engagement mechanisms stabilize the pusher paddle.

21 Claims, 19 Drawing Sheets

(56) References Cited

U.S. PATENT DOCUMENTS

| | | | | |
|---|---|---|---|---|
| D480,231 | S | 10/2003 | Valiulis et al. | |
| 6,772,888 | B2 | 8/2004 | Burke | |
| 9,265,358 | B2 | 2/2016 | Hardy | |
| 9,392,884 | B2 | 7/2016 | Juric | |
| 9,486,089 | B1 * | 11/2016 | Ng | A47F 1/126 |
| 9,521,913 | B2 | 12/2016 | Vogler et al. | |
| 9,629,479 | B2 | 4/2017 | Sosso et al. | |
| D820,016 | S | 6/2018 | Pena et al. | |
| D836,940 | S | 1/2019 | Pena et al. | |
| 10,441,092 | B2 * | 10/2019 | Hardy | A47F 1/126 |
| 10,786,093 | B2 * | 9/2020 | Pena | A47F 5/005 |
| 11,051,637 | B2 * | 7/2021 | Hardy | A47F 5/10 |
| 2002/0148794 | A1 * | 10/2002 | Marihugh | A47F 1/126 211/59.3 |
| 2011/0180498 | A1 * | 7/2011 | Kidd | A47F 1/126 211/59.3 |
| 2014/0305890 | A1 | 10/2014 | Vogler et al. | |
| 2017/0119174 | A1 * | 5/2017 | Hardy | A47F 5/10 |
| 2018/0310725 | A1 * | 11/2018 | Pena | A47F 5/005 |
| 2019/0200782 | A1 * | 7/2019 | Kologe | A47F 5/005 |
| 2020/0170421 | A1 * | 6/2020 | Hardy | A47F 1/126 |

* cited by examiner

PRODUCT DISPLAY PUSHER SYSTEM

CROSS REFERENCE TO PRIOR APPLICATIONS

This application is a continuation of U.S. application Ser. No. 15/964,792 filed on Apr. 27, 2018, now U.S. Pat. No. 10,786,093, issued Sep. 29, 2020, which is hereby incorporated by reference in its entirety for all purposes as if fully set forth herein, which application claims the benefit from U.S. Provisional Application No. 62/491,460 filed on Apr. 28, 2017, which is hereby incorporated by reference in its entirety for all purposes as if fully set forth herein.

FIELD OF THE DISCLOSURE

The disclosure relates to a product display pusher system. More particularly, the disclosure relates to a product display pusher system configured for enhanced display capabilities and operation for displaying products.

BACKGROUND OF THE DISCLOSURE

A number of product displays currently exist. However, operation of these current product displays is deficient. Components of the current product display are unstable, products are not moved effectively, and the performance of the display is lacking. Additionally, the displays are typically built for smaller items and/or items having less weight. These current product displays accordingly operate unsatisfactorily with products including larger products and/or products having greater weight.

Accordingly, a product display that is more stable, can handle larger products, handle heavier products, operate more effectively, and/or the like is needed.

SUMMARY OF THE DISCLOSURE

The foregoing needs are met, to a great extent, by the disclosure, wherein in one aspect a technique and apparatus are provided for a product display pusher system.

In accordance with one aspect a pusher tray assembly configured to hold product includes a pusher tray including a floor configured to hold the product thereon; the pusher tray including a front wall, at least one sidewall, and at least one back wall; a pusher paddle having a front face and a back face; a plurality of engagement mechanisms arranged on a lower side of the pusher paddle and configured to secure the pusher paddle to the floor; a plurality of channels arranged in the floor and configured to receive the plurality of engagement mechanisms; and a spring configured to urge the pusher paddle towards the front wall, wherein the plurality of engagement mechanisms stabilize the pusher paddle.

In accordance with another aspect a pusher tray assembly configured to hold product includes a pusher tray including a floor configured to hold the product thereon; the pusher tray including a front wall, at least one sidewall, and at least one back wall; a pusher paddle having a front face and a back face; at least one engagement mechanism arranged on a lower side of the pusher paddle and configured to secure the pusher paddle to the floor; at least one channel arranged in the floor and configured to receive the at least one engagement mechanism; a spring configured to urge the pusher paddle towards the front wall; and a plurality of fins arranged on the back face of the pusher paddle and configured to engage the floor, wherein the plurality of fins stabilize the pusher paddle.

In accordance with yet another aspect a pusher tray assembly configured to hold product includes a pusher tray including a floor configured to hold the product thereon; the pusher tray including a front wall, at least one sidewall, and at least one back wall; a pusher paddle having a front face and a back face; a plurality of engagement mechanisms arranged on a lower side of the pusher paddle and configured to secure the pusher paddle to the floor; a plurality of channels arranged in the floor and configured to receive the plurality of engagement mechanisms; a spring configured to urge the pusher paddle towards the front wall, wherein the plurality of engagement mechanisms stabilize the pusher paddle; a plurality of fins arranged on the back face of the pusher paddle and configured to engage the floor, wherein the plurality of fins stabilize the pusher paddle; and the pusher tray assembly further includes at least one of the following: a locking feature arranged on the front wall, the locking feature configured to lock the pusher tray to a shelf; a snap assembly arranged on the floor, the snap assembly configured to secure the pusher tray to a corresponding feature on the shelf; and a secondary attachment portion arranged in the floor, the secondary attachment portion configured to receive a fastener to fasten the pusher tray to the shelf.

There has thus been outlined, rather broadly, certain aspects of the disclosure in order that the detailed description thereof herein may be better understood, and in order that the present contribution to the art may be better appreciated. There are, of course, additional aspects of the disclosure that will be described below and which will form the subject matter of the claims appended hereto.

In this respect, before explaining at least one aspect of the disclosure in detail, it is to be understood that the disclosure is not limited in its application to the details of construction and to the arrangements of the components set forth in the following description or illustrated in the drawings. The disclosure is capable of aspects in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods, and systems for carrying out the several purposes of the disclosure. It is important, therefore, that the claims be regarded as including such equivalent constructions insofar as they do not depart from the spirit and scope of the disclosure.

DETAILED DESCRIPTION

Figure 1:
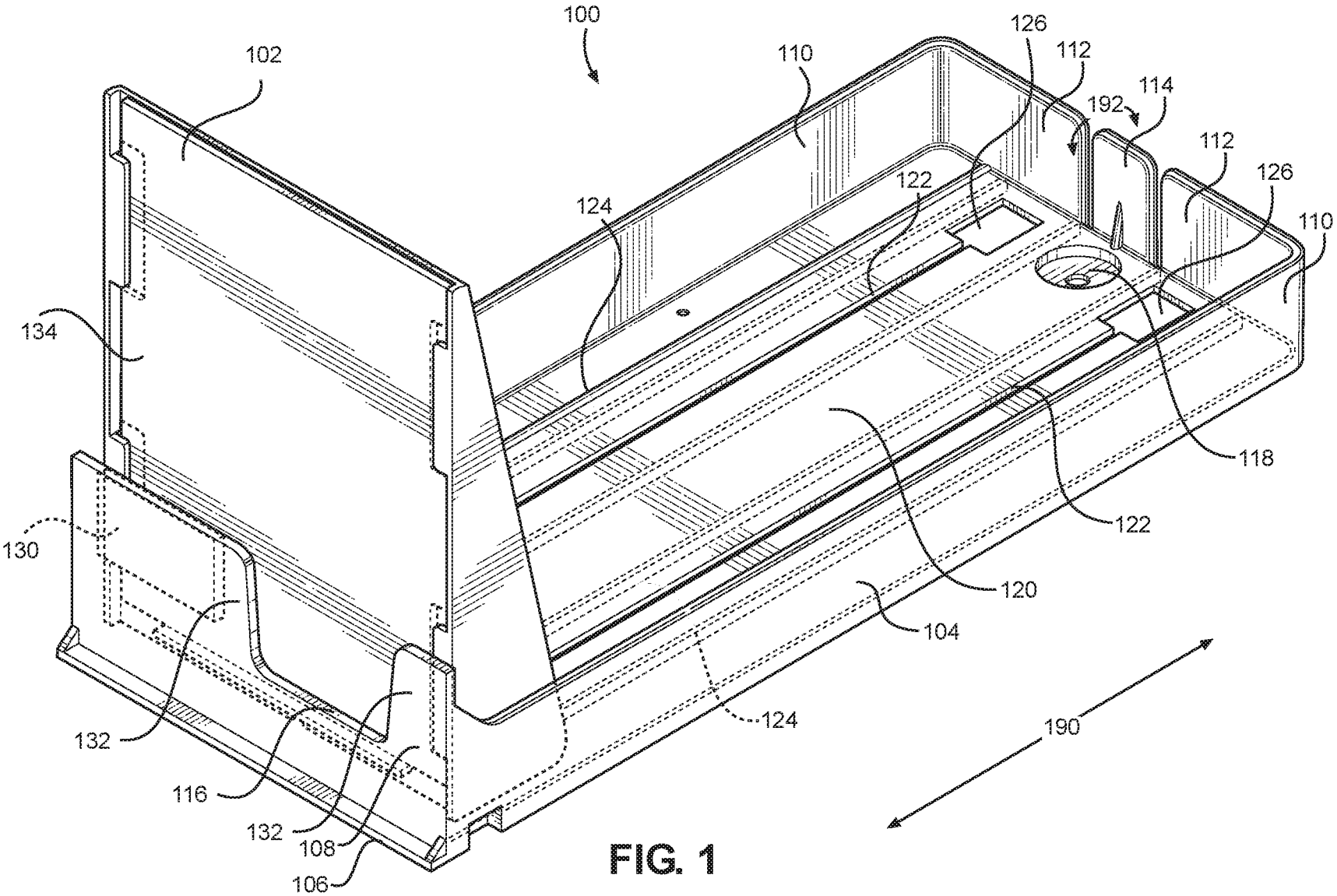
FIG. 1 illustrates a front perspective view of a product display pusher system according to aspects of the disclosure.

The disclosure will now be described with reference to the drawing figures, in which like reference numerals refer to like parts throughout. Aspects of the disclosure advantageously provide a product display pusher system.

Figure 2:
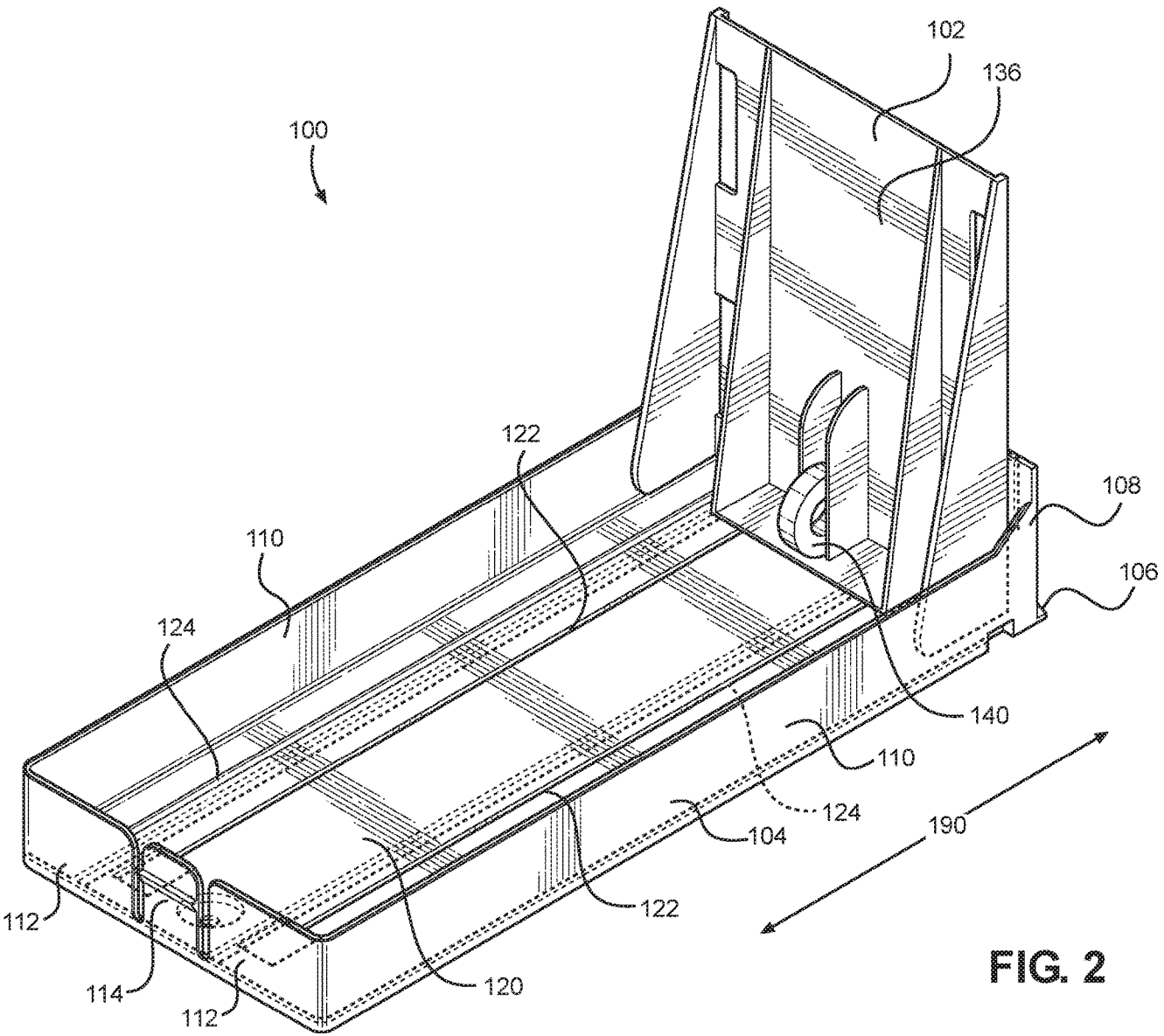
FIG. 2 illustrates a rear perspective view of the product display pusher system of FIG. 1.
Figure 3:
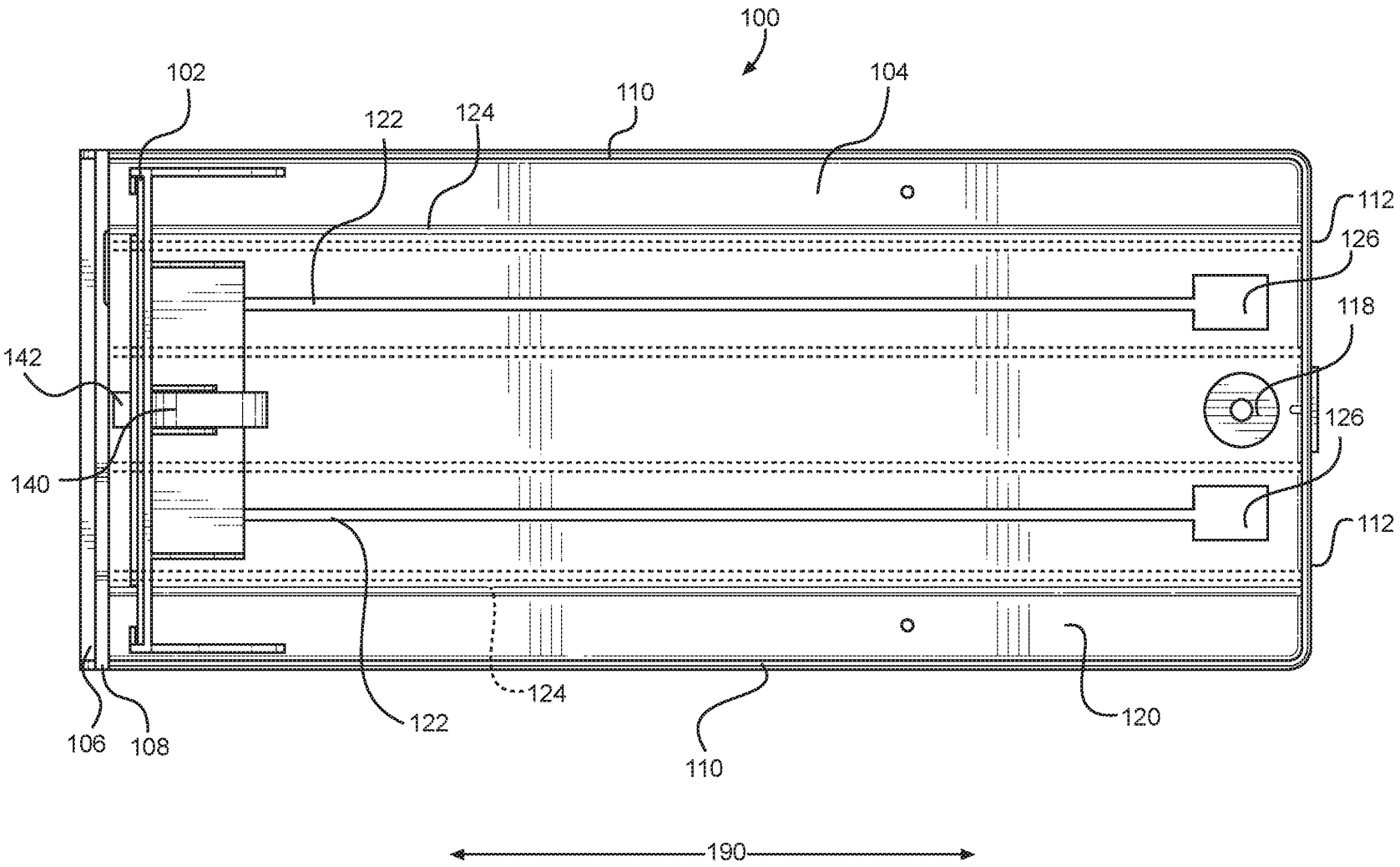
FIG. 3 illustrates a top view of the product display pusher system of FIG. 1.
Figure 4:
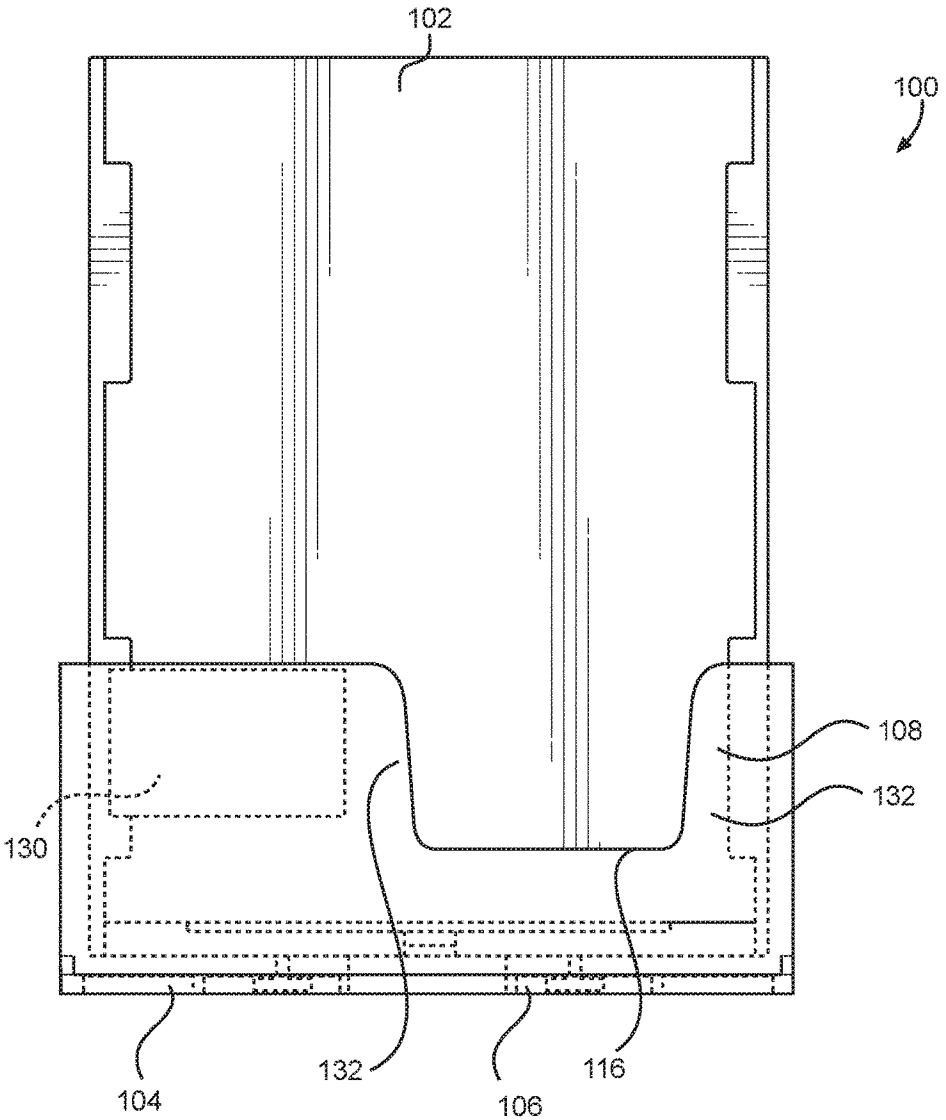
FIG. 4 illustrates a front view of the product display pusher system of FIG. 1.
Figure 5:
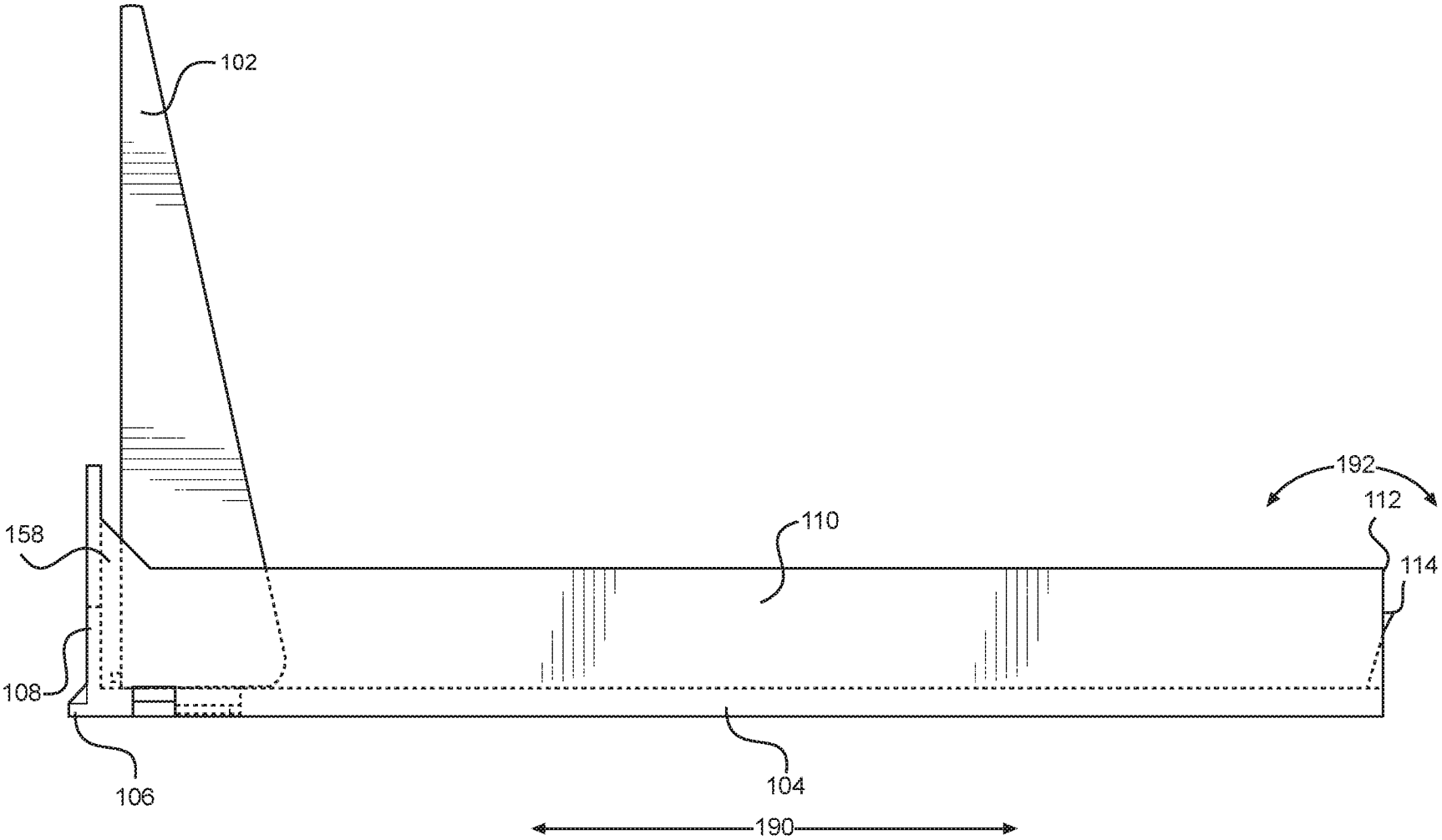
FIG. 5 illustrates a side view of the product display pusher system of FIG. 1.
Figure 6:
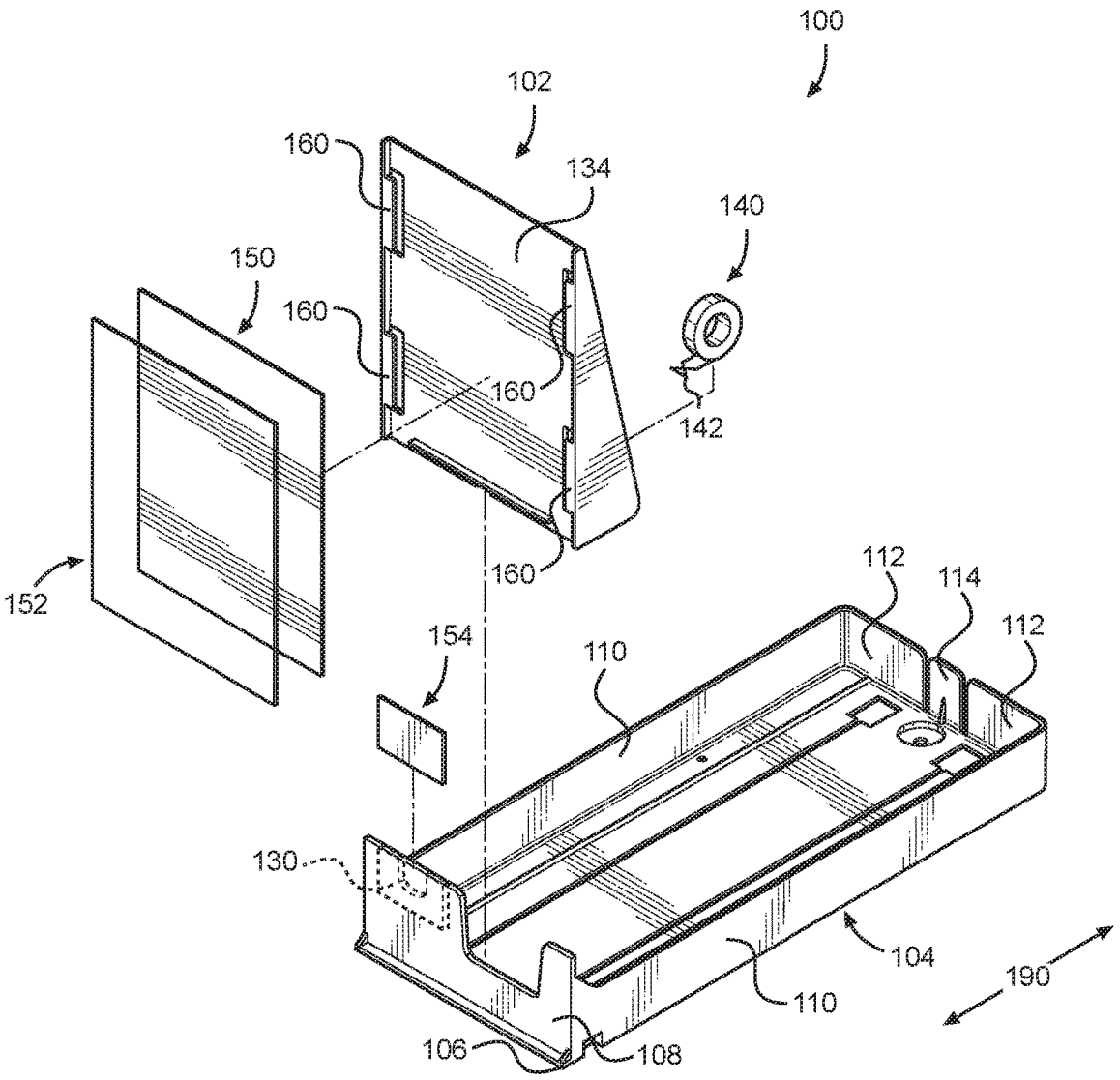
FIG. 6 illustrates an exploded view of the product display pusher system of FIG. 1.

FIG. 1 illustrates a front perspective view of a product display pusher system according to aspects of the disclosure; FIG. 2 illustrates a rear perspective view of the product display pusher system of FIG. 1; FIG. 3 illustrates a top view of the product display pusher system of FIG. 1; FIG. 4 illustrates a front view of the product display pusher system of FIG. 1; FIG. 5 illustrates a side view of the product display pusher system of FIG. 1; and FIG. 6 illustrates an exploded view of the product display pusher system of FIG. 1. As illustrated in FIGS. 1-6, a pusher tray assembly 100 includes a pusher tray 104 and a pusher paddle 102. The pusher tray assembly 100 may be configured to be arranged on a shelf of a retail establishment for holding product as shown in FIGS. 16-20. The product may be arranged within the pusher tray 104 on a floor 120 between side walls 110, a front wall 108, and the pusher paddle 102.

The pusher tray assembly 100 may further include a locking feature 106. The locking feature 106 may extend from the front wall 108 and may be engaged with a corresponding slot in the shelf. The locking feature 106 may be a generally rectangular extension that extends along the width of the front wall 108. Moreover, the locking feature may extend horizontally out from the front wall 108 as shown in FIG. 5. In one aspect, the locking feature 106 may engage the corresponding slot in the shelf and prevent forward movement of the pusher tray assembly 100. Forward movement of the pusher tray assembly 100 would result in the pusher tray assembly 100 falling out of the front of the shelf on which it is positioned. Additionally, engagement of the locking feature 106 to the corresponding slot in the shelf also prevents vertical movement of the pusher tray assembly 100, Accordingly, a customer can grasp a product and lift the product vertically from the pusher tray assembly 100 without the pusher tray assembly 100 lifting off the shelf on which it is supported. Other or alternative locking features are contemplated as well.

The pusher paddle 102 is configured to move generally horizontally across the floor 120 of the pusher tray 104 parallel to the direction of arrow 190. When there is no product in the pusher tray assembly 100, the pusher paddle 102 may travel to the front wall 108 as shown in FIG. 1. As product is inserted into the pusher tray assembly 100, the pusher paddle 102 may travel horizontally parallel to the arrow 190 towards the back wall 112. This is shown in FIGS. 16-20 and described in detail below.

The pusher paddle 102 may further include an engagement mechanism that may engage channels 122 arranged in the floor 120. The channels 122 may be generally rectangular slots that extend through the floor 120. Other shaped structures for the channels 122 are contemplated as well. During assembly, the engagement mechanism may be inserted into insertion slots 126. The insertion slots 126 may be rectangular apertures having a size commensurate with the engagement mechanism of the pusher paddle 102. Other shaped configurations of the insertion slots 126 are contemplated as well. Once the pusher paddle moves from the location of the insertion slots 126 in the direction of arrow 190 toward the front wall 108, the engagement mechanism may be held securely in the channels 122. While the pusher paddle 102 is arranged above the insertion slots 126 at its most rearward position adjacent the back wall 112, the pusher paddle 102 may be inserted or removed from the floor 120. The engagement mechanism is discussed in greater detail below.

The pusher paddle 102 may be further configured with a spring 140 illustrated in FIG. 2. The spring 140 may be a coiled spring having an end 142 (shown in FIG. 6) that is securely engaged with the pusher tray assembly 100. In one aspect, the end 142 of the spring 140 may be securely engaged to an attachment feature located in the front wall 108 and/or floor 120 adjacent the front wall 108. In one aspect, the end 142 of the spring 140 may be T-shaped. In one aspect, the spring may be a flat torsional spring. The spring 140 may be configured to coil into a cylinder as illustrated in FIG. 6. As the pusher paddle 102 is moved in the direction of arrow 190 toward the back wall 112 of the pusher tray assembly 100 the spring 140 may uncoil and provide a spring force to the pusher paddle 102 urging the pusher paddle 102 toward the front wall 108 of the pusher tray assembly 100. In one aspect, as the spring 140 uncoils, the force exerted by the spring 140 on the pusher paddle 102 increases. This may be beneficial as the spring 140 uncoils, more product is being held by the pusher tray assembly 100 increasing the required force to move the product forward towards the front wall 108. In other words, the configuration of the spring 140 provides a variable force to address the correspondingly variable weight of the product ensuring that the product is correspondingly moved toward the front wall 108. Accordingly, product arranged between a front face 134 of the pusher paddle 102 may be urged by the pusher paddle 102 in conjunction with the spring 140 to be moved toward that the front wall 108. Other types of mechanisms are contemplated to apply a spring or elastic force to the pusher paddle 102 to urge it toward the front wall 108.

The front wall 108 may be configured to face outwardly from the shelf for displaying the product. The front wall 108 may further include a window portion 116 that provides a larger area for a consumer to reach and grasp a product supported by the pusher tray assembly 100. Portions 132 in the front wall 108 extend vertically adjacent the window portion 116. The portions 132 forming a surface on which the product may press against. The front wall 108 may further include a graphic holder 130 described in greater detail below.

The pusher tray assembly 100 may further include a secondary attachment portion 118. The secondary attachment portion 118 may be a circular depression formed in the floor 120 of the pusher tray assembly 100. Additionally, the secondary attachment portion 118 may include an aperture for receiving a fastener. The circular depression receiving a head of the fastener such that the head the faster does not extend above an upper surface of the floor 1201, This construction of the circular depression prevents interference of a fastener with the motion and operation of the pusher paddle 102.

The sidewalls 110 may be connected to the floor 120 of the pusher tray 104. The floor 120 may be configured to be arranged in parallel to a support surface of the shelf on which the pusher tray assembly 100 is arranged. If the support surface shelf is horizontal, then the floor 120 will be arranged such that its major surface is horizontal to the support surface of the shelf. If the support surface shelf is inclined, then the floor 120 will be arranged such that its major surface is inclined parallel to the support surface of the shelf.

The sidewalls 110 may be connected to the floor 120 along the edges thereof. The sidewalls 110 may extend perpendicularly from the major surface of the floor 120, In one aspect, the sidewalls 110 may extend perpendicularly from the major surface of the floor 120 vertically. Likewise, the back walls 112 may be connected to the floor 120 along the edges thereof. The back walls 112 may extend perpendicularly from the major surface of the floor 120. In one aspect, the back walls 112 may extend perpendicularly from the major surface of the floor 120 vertically.

The floor 120 may further include rails 124 arranged thereon. The rails 124 may be raised portions of material on the floor 120. The rails 124 may form the contact surfaces on which a bottom surface of the product may be supported. The rails 124 may result in a small contact surface on which the bottom surface of the product is supported thus reducing friction. This small surface and reduced friction ensures that product slides along arrow 190 toward the front wall 108 as urged by the front face 134 of the pusher paddle 102 in response to a force provided by the spring 140.

The pusher tray assembly 100 may further include a snap assembly 114. The snap assembly 114 may be a portion extending from the pusher tray assembly 100 to engage with a portion on the shelf to securely lock the pusher tray assembly 100 to the shelf. In one aspect, the snap assembly 114 may be a generally rectangular extension that extends vertically from the floor 120 generally parallel to the back walls 112 as shown in FIG. 1. In one aspect, the shelf may have a slot configured to receive a part of the snap assembly 114. The snap assembly 114 may be connected only along a bottom edge thereof to the floor 120 and may include slots between the snap assembly 114 and the back walls 112. The snap assembly 114 may, due to its elastic nature, move along the direction of arrow 192. In this regard, an installer may move the snap assembly 114 along the arrow 192 toward the front wall 108 during installation, the elastic nature of the snap assembly 114 moving along the arrow 192 in the opposite direction toward the back wall 112 to engage in a corresponding structure of the shelf to lock the pusher tray assembly 100 more securely to the shelf.

As illustrated in FIG. 5, the sidewall 110 may include the strengthening portion 158 for engagement with the front wall 108. The strengthening portion 158 may thus result in a larger connection between the sidewall 110 and the front wall 108 providing increased strength.

As illustrated in FIG. 6, the pusher tray assembly 100 may further include a paddle graphic portion 150. The paddle graphic portion 150 may include an image of the product to be held by the pusher tray assembly 100. Accordingly, when an individual is placing product into pusher tray assembly 100 they may be clearly informed of the correct product for placement in the pusher tray assembly 100. Additionally, customers looking for a particular product may more clearly recognize a desired product even if that product is currently out of stock. Thus, the customer can then seek help from the retail establishment for obtaining the product from, for example, the stock room. Additionally, to protect the paddle graphic portion 150, a clear implementation of the paddle graphic cover 152 may be arranged on the paddle graphic portion 150. Both the paddle graphic portion 150 and the paddle graphic cover 152 may be held on the front face 134 of the pusher paddle 102 as illustrated in FIG. 6. Additionally, the pusher paddle 102 may further include a plurality of tabs 160 extending parallel to the front face 134 of the pusher paddle 102. The tabs 160 may provide a space or slot between the front face 134 and the tabs 160 for insertion of the paddle graphic portion 150 and paddle graphic cover 152. Accordingly, the tabs 160 may form a mechanism to securely hold the paddle graphic portion 150 and paddle graphic cover 152 to the front face 134 of the pusher paddle 102.

The pusher tray assembly 100 may further include a graphic holder 130 arranged on the front wall 108. The graphic holder 130 may hold a graphic 154 therein. The graphic holder 130 may have a generally rectangular construction that forms a slot or open area between a front surface of the graphic holder 130 and the front wall 108. The slot or open area provides a location for the graphic 154 to be located. For example, the graphic 154 may be a price tag, a barcode, a product description, and/or the like.

Figure 7:
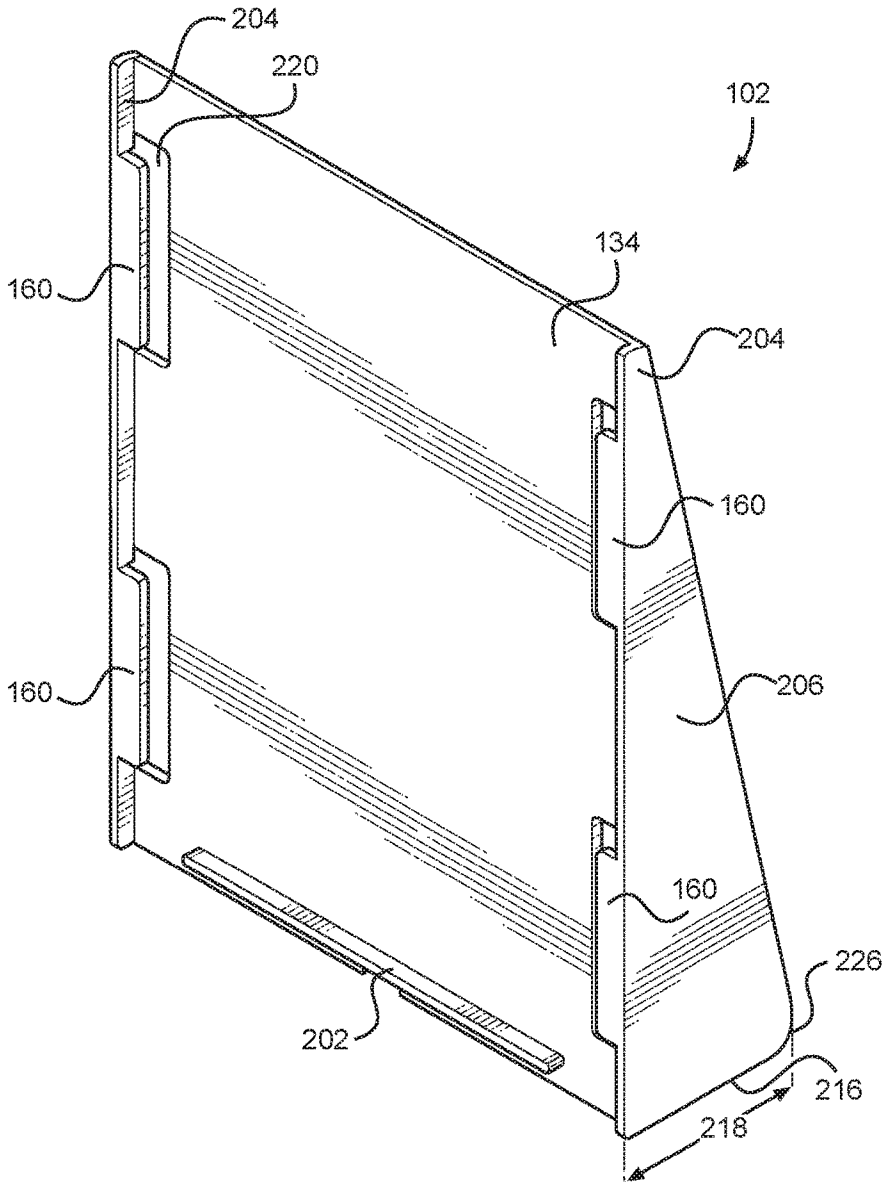
FIG. 7 illustrates a front perspective view of a pusher paddle of the product display pusher system of FIG. 1.
Figure 8:
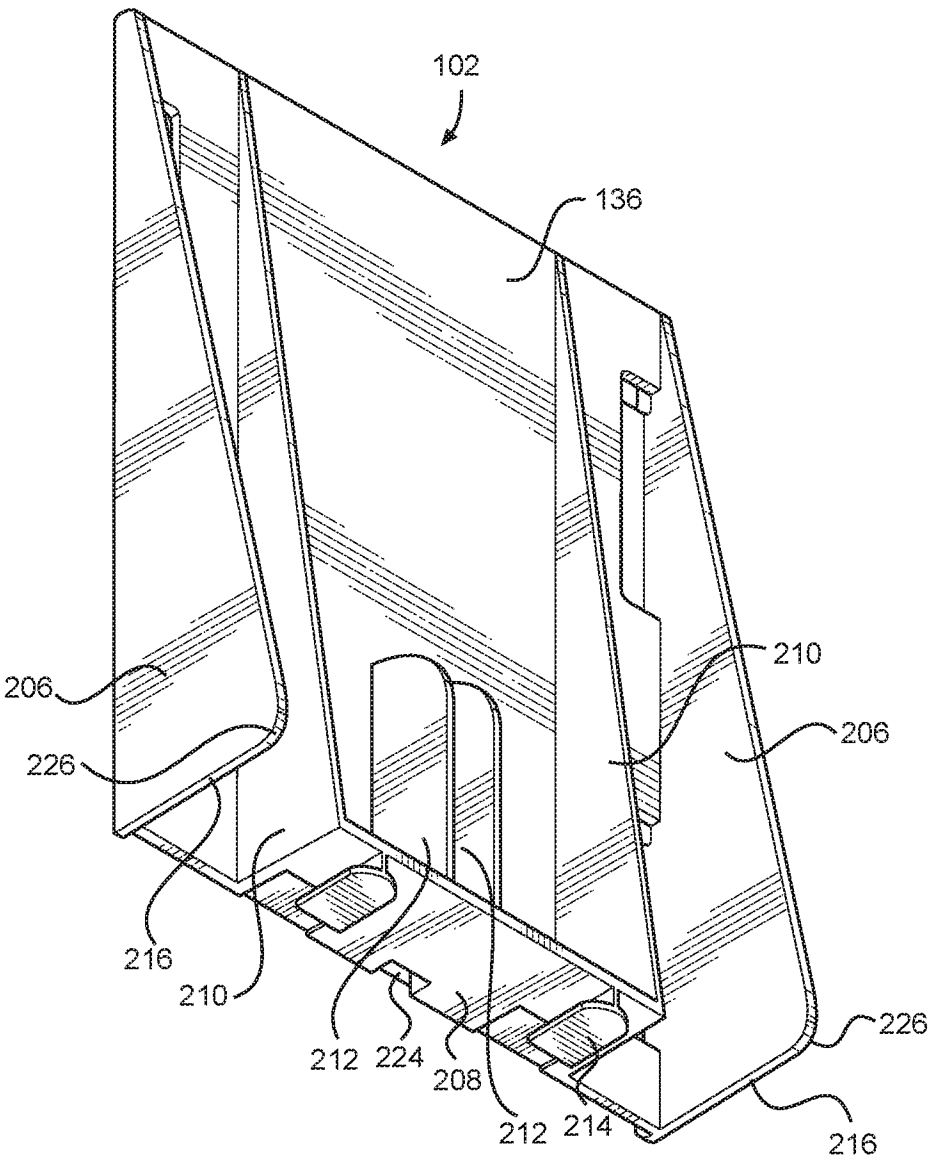
FIG. 8 illustrates a back perspective view of a pusher paddle of the product display pusher system of FIG. 1.
Figure 9:
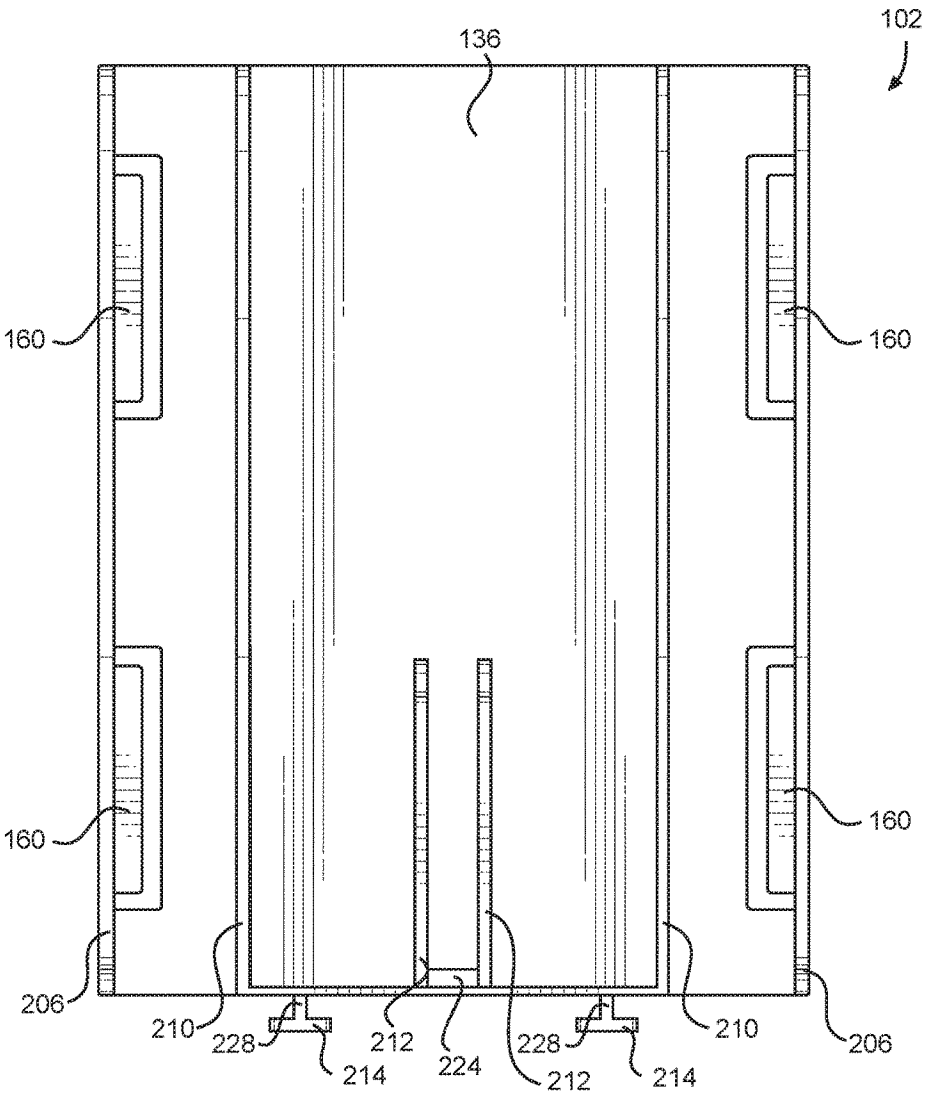
FIG. 9 illustrates a back view of a pusher paddle of the product display pusher system of FIG. 1.
Figure 10:
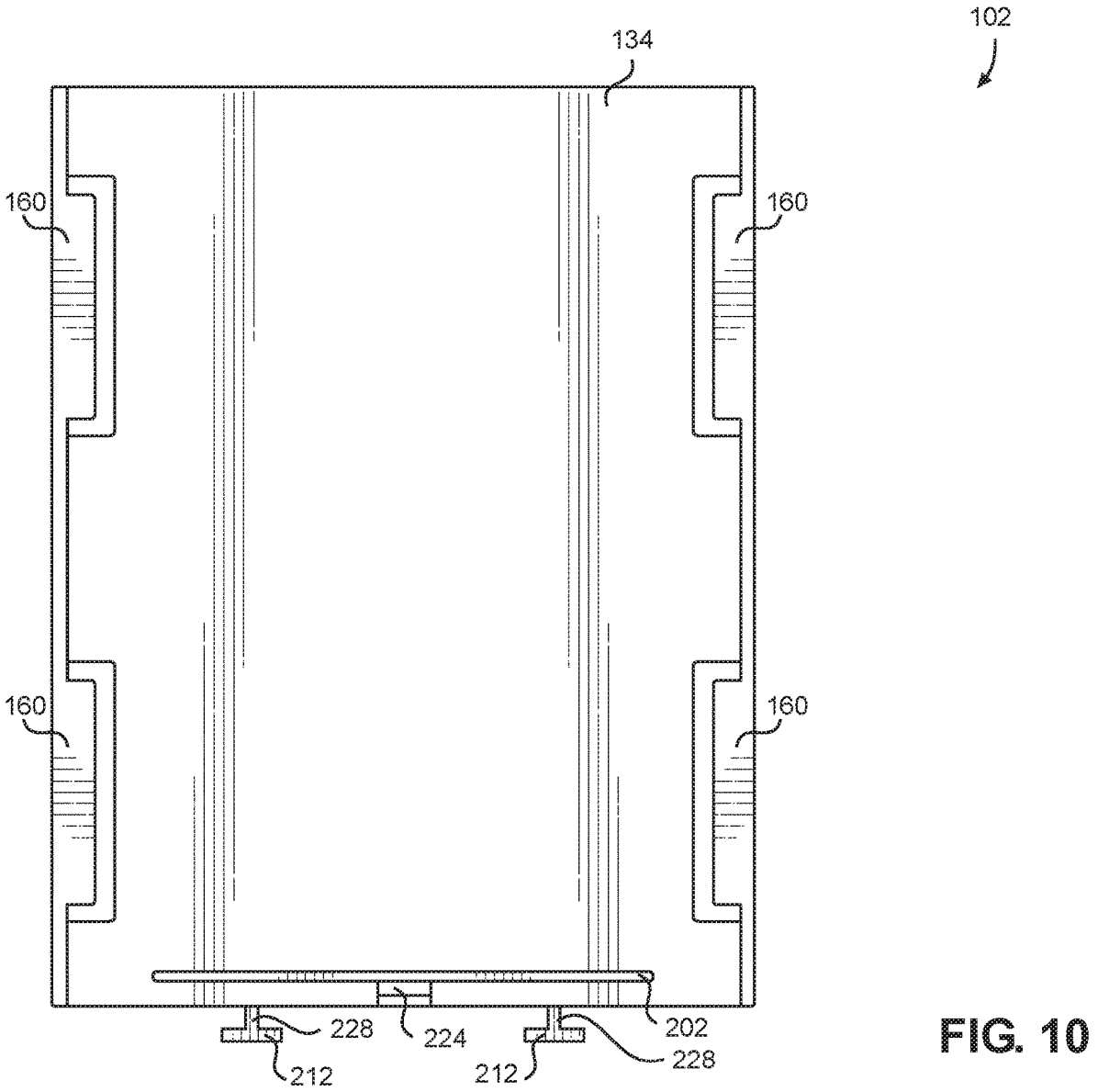
FIG. 10 illustrates a front view of a pusher paddle of the product display pusher system of FIG. 1.
Figure 11:
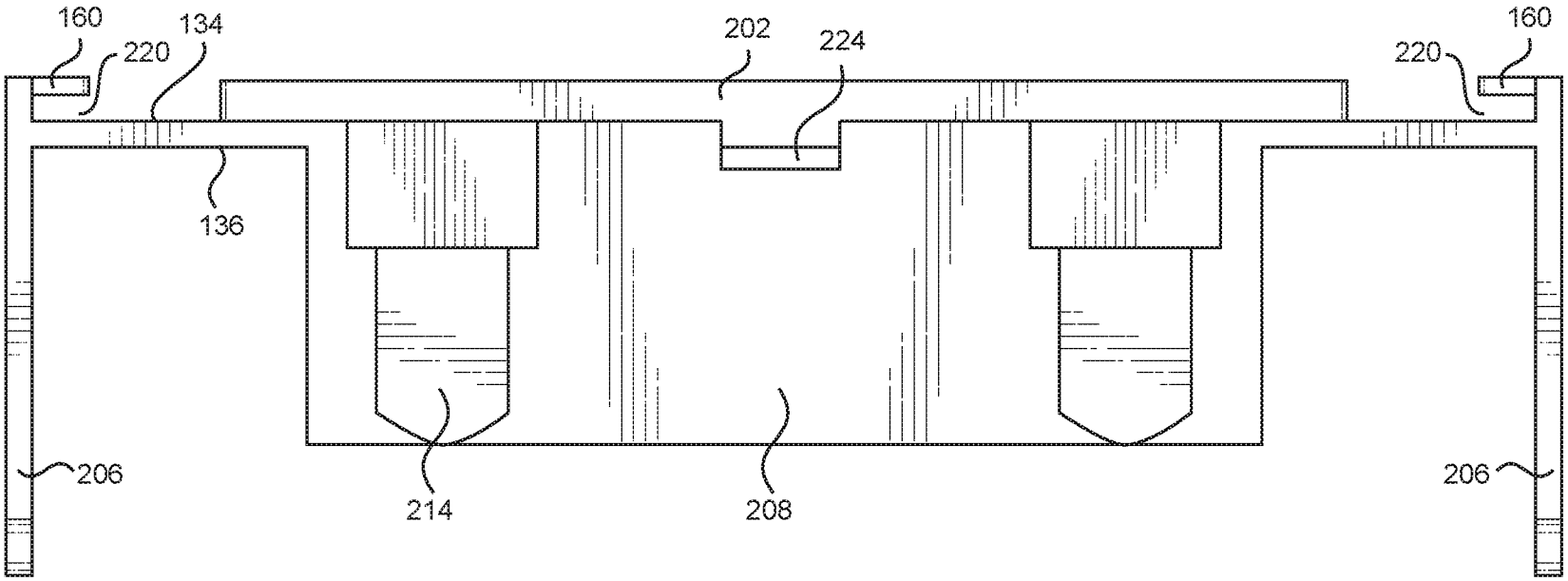
FIG. 11 illustrates the bottom view of a pusher paddle of the product display pusher system of FIG. 1.

FIG. 7 illustrates a front perspective view of a pusher paddle of the product display pusher system of FIG. 1; FIG. 8 illustrates a back perspective view of a pusher paddle of the product display pusher system of FIG. 1; FIG. 9 illustrates a back view of a pusher paddle of the product display pusher system of FIG. 1; FIG. 10 illustrates a front view of a pusher paddle of the product display pusher system of FIG. 1; and FIG. 11 illustrates the bottom view of a pusher paddle of the product display pusher system of FIG. 1. As illustrated in FIGS. 7-11, the pusher paddle 102 may include the front face 134 with the tabs 160 arranged thereon. In particular, the tabs 160 may be attached to or integrated in side edges 204. Attachment of the tabs 160 to the side edges 204 may form a slot 220 between the tabs 160, the front face 134, and the side edges 204. The slot 220 may form a region for the paddle graphic portion 150 and the paddle graphic cover 152 to be inserted therein. Additionally, the pusher paddle 102 may include a support edge 202 along a bottom edge of the front face 134. The support edge 202 may support a bottom edge of the paddle graphic portion 150 and the paddle graphic cover 152.

The side edges 204 of the pusher paddle 102 may further include fin portions 206. The fin portions 206 may have a generally triangular shape. The fin portions 206 may include a bottom edge 216. The bottom edge 216 having a larger dimensioned configuration of the width 218. The width 218 of the fin portions 206 providing increased stability for the pusher paddle 102 as it traverses the floor 120. More specifically, the width 218 helps to ensure that the front face 134 remains vertical as the pusher paddle 102 travels across the floor 120 in the direction of arrow 190 illustrated in FIG. 1. In one aspect, the width 218 is 1.6 inches to 2.4 inches. In one aspect, the width 218 is 1.8 inches to 2.3 inches. In one aspect, the width 218 is 1.9 inches to 2.1 inches.

Additionally, the fin portions 206 may include a curved portion 226 that smooths operation of the movement of the pusher paddle 102 in the direction of arrow 190 toward the back wall 112. The fin portion 206 may include a curved portion toward the front face 134 as well (not shown).

As shown in FIG. 8, the pusher paddle 102 may include a bottom surface 208. The bottom surface 208 contacting the floor 120 of the pusher tray 104 and providing stability for the pusher paddle 102. The pusher paddle 102 may further include strengthening portions 210 along the back face 136. The strengthening portions 210 may connect to the back face 136 as well as the bottom surface 208 to provide strength and support thereof.

The bottom surface 208 may further include track engagement mechanisms 214. The track engagement mechanisms 214 may be inserted into the insertion slot 126 illustrated in FIG. 1 and may be positioned below the floor 120 thereafter. As illustrated in FIG. 9, the track engagement mechanism 214 may include extensions 228. The track engagement mechanisms 214 may be generally horizontal or parallel to the major surface of the floor 120. The extensions 228 may be connected to the track engagement mechanisms 214 and the extensions may also be connected to the bottom surface 208. The extensions 228 may extend through the channels 122 of the floor 120 illustrated in FIG. 1. Hence, once the track engagement mechanism 214 is extended into the insertion slot 126, the pusher paddle 102 can traverse back and forth along the arrow 190 in the pusher tray assembly 100 in a manner such that the pusher paddle 102 cannot be easily separated from the pusher tray assembly 100. This may be due to the track engagement mechanisms 214 being locked into and below the channels 122. Although a single implementation of the engagement mechanism 214 is contemplated by the disclosure, in some aspects there may be multiple engagement mechanisms 214 as illustrated in the Figures. In this regard, having multiple engagement mechanisms 214 increases the stability of the pusher paddle 102. Moreover, the multiple engagement mechanisms 214 being separated by a distance also increases the stability. In one aspect, the multiple engagement mechanisms 214 may be separated by distance greater than 2 inches. In one aspect, the multiple engagement mechanisms 214 may be separated by distance greater than 2.5 inches. In one aspect, the multiple engagement mechanisms 214 may be separated by distance between 2.5 inches and 3.5 inches.

The pusher paddle 102 may further include spring supports 212. The spring supports 212 may be attached to the bottom surface 208 and the back face 136. The spring 140 may be positioned between the spring supports 212 and the end of the spring 140 may extend out a spring slot 224 arranged on the front face 134 and the back face 136 of the pusher paddle 102.

Figure 12:
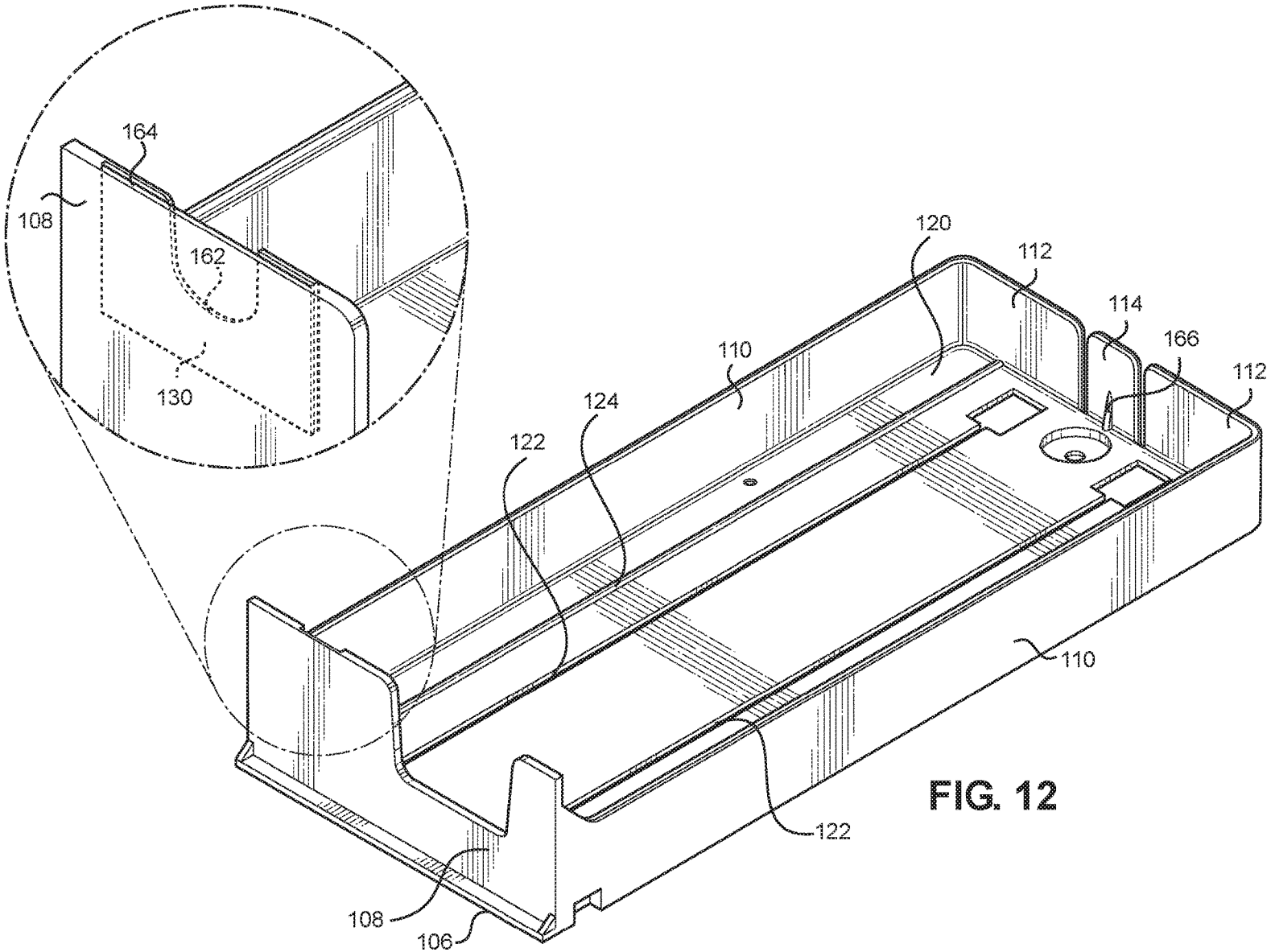
FIG. 12 illustrates a front perspective view of a product display pusher system with the paddle pusher removed together with a detailed image according to aspects of the disclosure.

FIG. 12 illustrates a front perspective view of a product display pusher system with the paddle pusher removed together with a detailed image according to aspects of the disclosure. In particular, FIG. 12 illustrates the graphic holder 130 in greater detail. The graphic holder 130 may be attached to the front wall 108. The front wall 108 may include a window portion 162 that may be located behind the graphic holder 130. The graphic holder 130 may be a clear component allowing a customer to view the graphic held by the graphic holder 130 therethrough. The graphic holder 130 may form a slot 164 between a back surface of the graphic holder 130 and a front surface of the front wall 108. The graphic holder 130 may have a generally rectangular construction and the slot 164 may be generally rectangular as well. The window portion 162 may allow a user to more easily grasp the graphic held by the graphic holder 130.

FIG. 12 further illustrates that the snap assembly 114 may include a strengthening portion 166. The strengthening portion 166 connecting to a front surface of the snap assembly 114 and extending down to the floor 120 and may connect to the floor 120. The strengthening portion 166 may provide additional elastic force and strength to the snap assembly 114. In some aspects, the strengthening portion 166 may be thinnest at the upper end thereof, and becomes increasingly thicker as it extends downwardly toward the floor 120.

Figure 13:
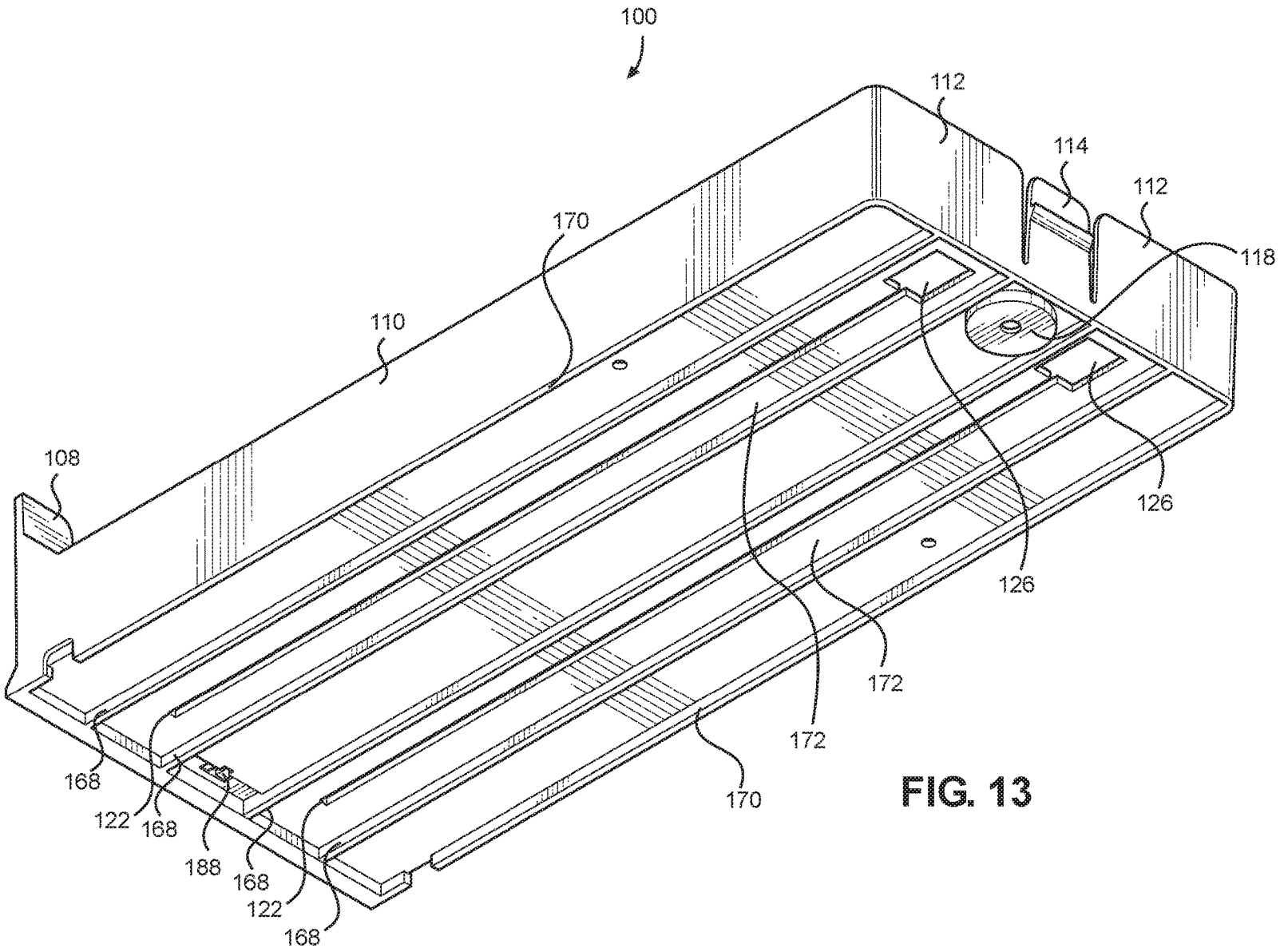
FIG. 13 illustrates a bottom perspective view of a product display pusher system with the paddle pusher removed according to aspects of the disclosure.

FIG. 13 illustrates a bottom perspective view of a product display pusher system with the paddle pusher removed according to aspects of the disclosure. In particular, FIG. 13 illustrates that the pusher tray assembly 100 may further include strengthening ribs 168. The strengthening ribs 168 may provide additional strength to the floor 120 of the pusher tray assembly 100. Additionally, the pusher tray assembly 100 may include side edge extensions 170 that also provide additional strength.

FIG. 13 further shows the channels 122 through which the track engagement mechanism 214 may be located once the pusher paddle 102 is inserted into the pusher tray assembly 100. The track engagement mechanism 214 may be located on a surface 172 illustrated in FIG. 13 when installed. FIG. 13 further illustrates that the pusher tray assembly 100 may include a slot 188. The slot 188 may be configured to receive the end 142 of the spring 140. The end 142 may be a flat structure having a T-shape. This flat structure may be inserted into the slot 188 and rotated 90° such that the top of the T-shaped portion of the end 142 extends out the slot 188. The narrow portion of the T-shaped portion of the end 142 may remain in the slot 188. The remaining portion of the spring 144 attached to the end 142, which may have a flat rectangular construction may be located above the floor 120 on the top side of the pusher tray assembly 100.

Figure 14:
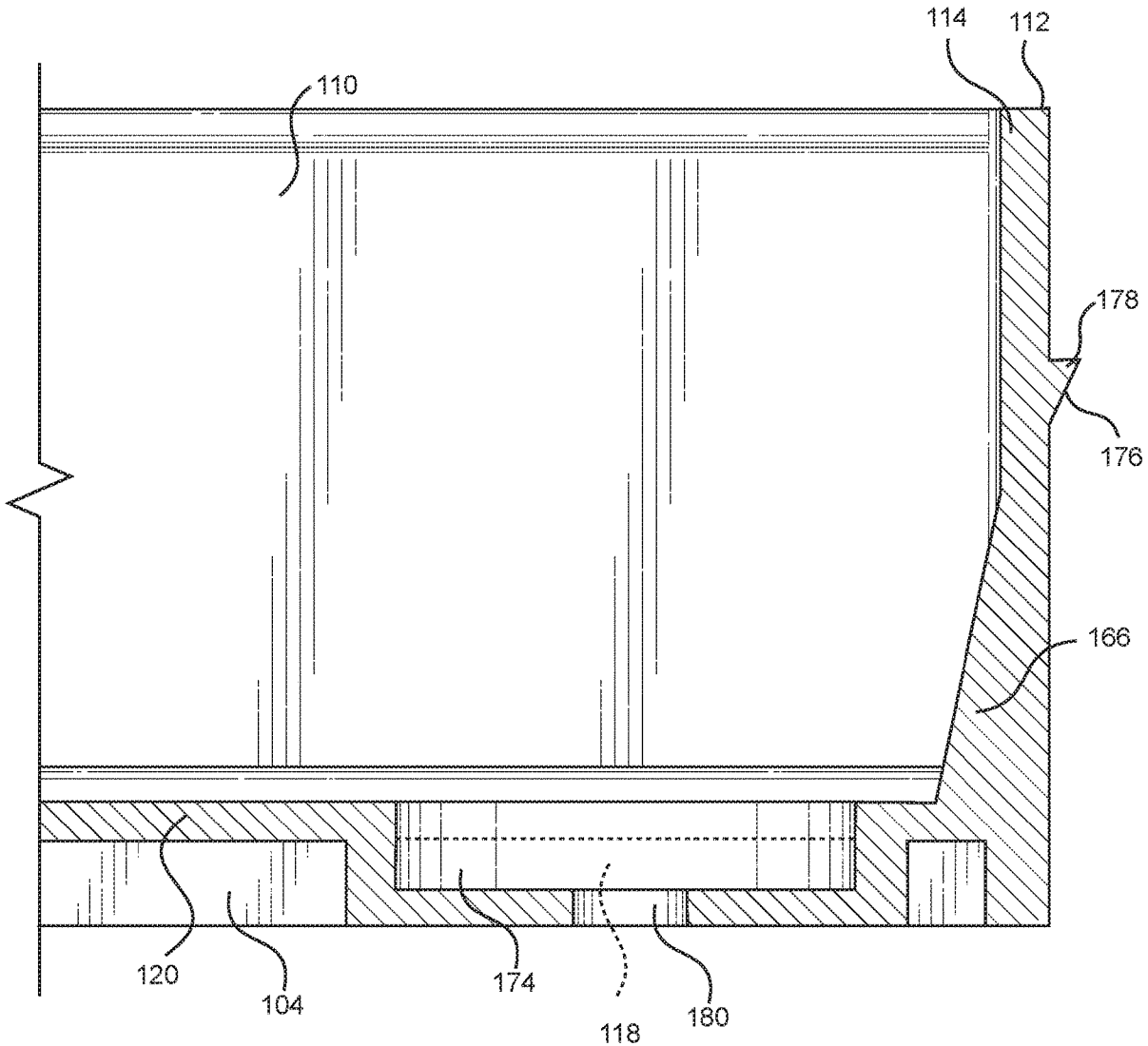
FIG. 14 illustrates a partial cross-sectional view of a product display pusher system according to aspects of the disclosure.

FIG. 14 illustrates a partial cross-sectional side view of a product display pusher system according to aspects of the disclosure. In particular, FIG. 14 shows greater detail of the secondary attachment portion 118. As noted previously, the secondary attachment portion 118 may include a depressed region 174 that may be arranged below the floor 120 such that a fastener head (not shown) may be located in the depressed region 174. This location of the fastener head may prevent undesired contact with the product and/or the pusher paddle 102. The secondary attachment portion 118 may further include an aperture 180 through which the fastener may extend for connection to the shelf or other structure.

FIG. 14 further shows details of the snap assembly 114 together with the strengthening portion 166. The snap assembly 114 may include an extension 176 and engagement edge 178.

Figure 15:
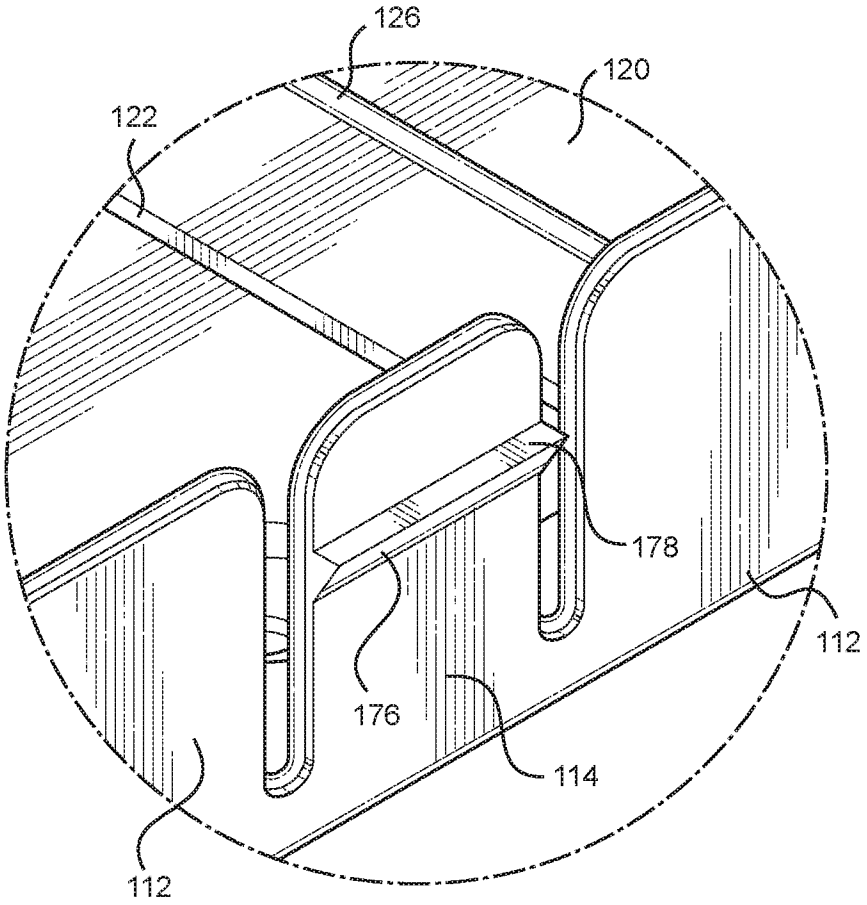
FIG. 15 illustrates a partial perspective back view of a product display pusher system according to aspects of the disclosure.

FIG. 15 illustrates a partial perspective back view of a product display pusher system according to aspects of the disclosure. In particular, FIG. 15 illustrates the snap assembly 114 together with the extension 176 and the engagement edge 178. The extension 176 extending away from the surface of the snap assembly 114. On the extension 176 may be the engagement edge 178. The engagement edge 178 may engage a corresponding edge or slot on the shelf in order to secure the pusher tray assembly 100 to the shelf. In one aspect, the slot in the shelf may include a substantially horizontal edge that may engage the engagement edge 178 and a locking manner. The engagement edge 178 may have a surface that is substantially horizontal.

Figure 16:
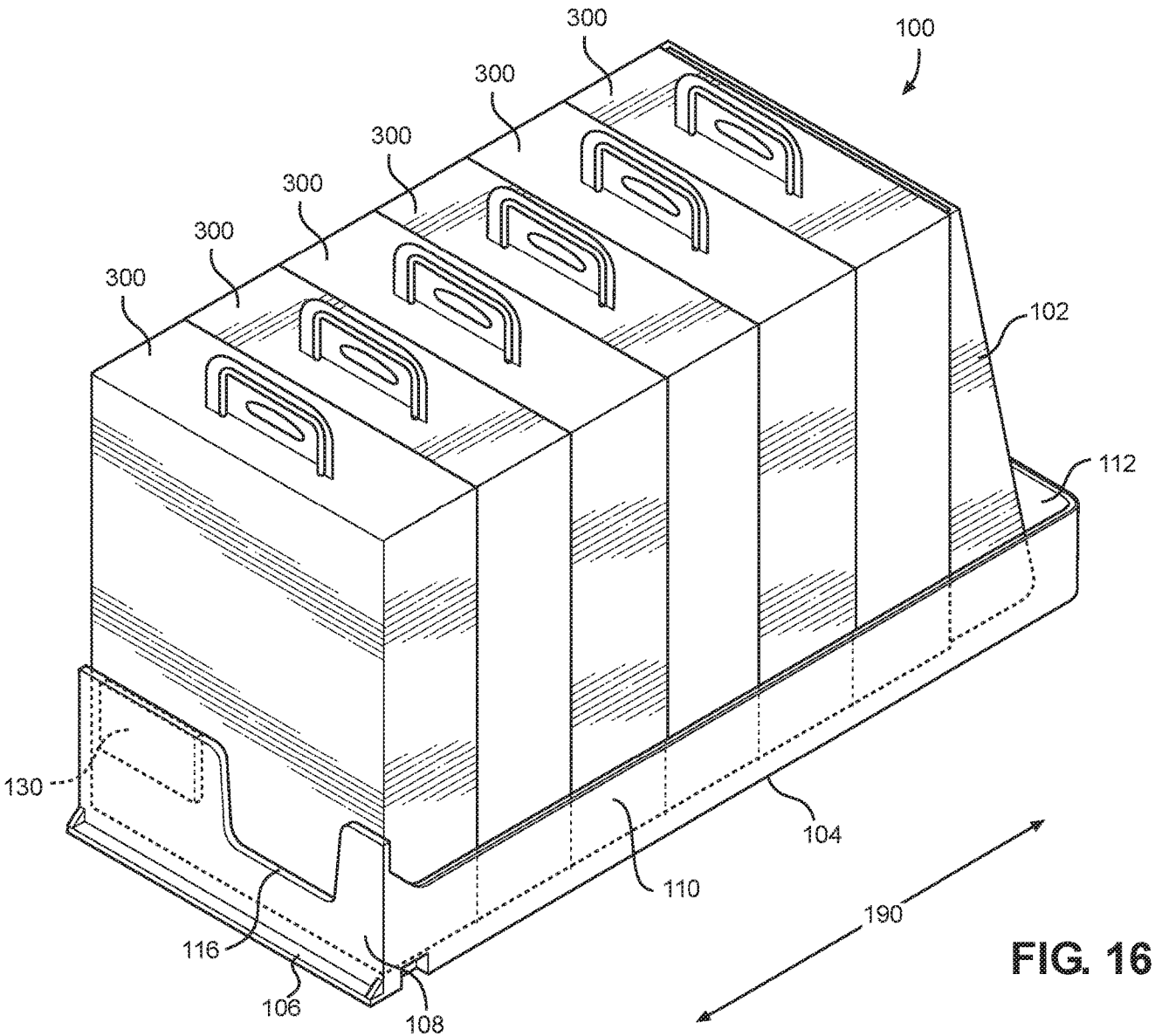
FIG. 16 illustrates a front perspective view of the product display pusher system of FIG. 1 with product arranged for display.
Figure 17:
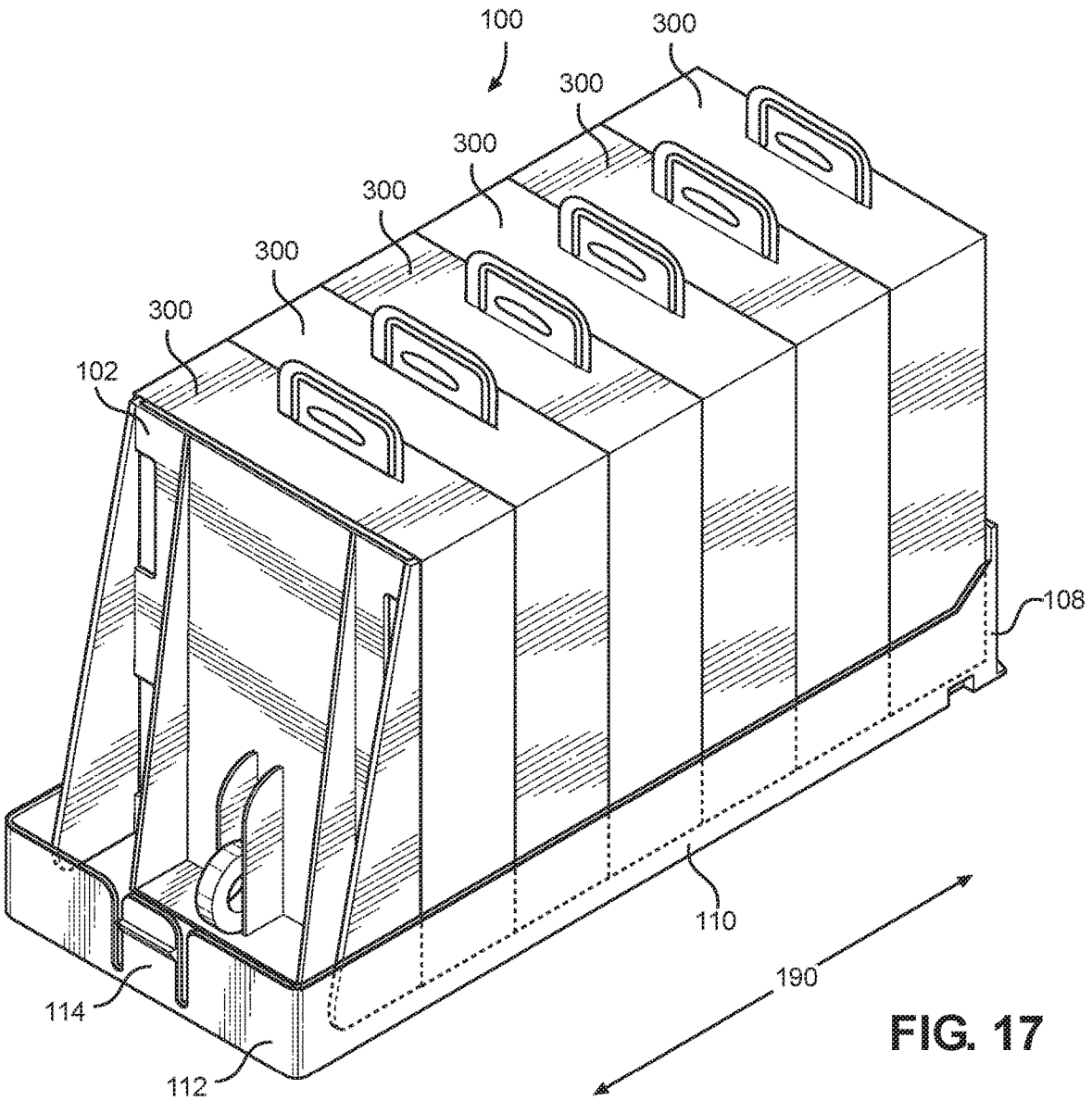
FIG. 17 illustrates a back perspective view of the product display pusher system of FIG. 1 with product arranged for display.
Figure 18:
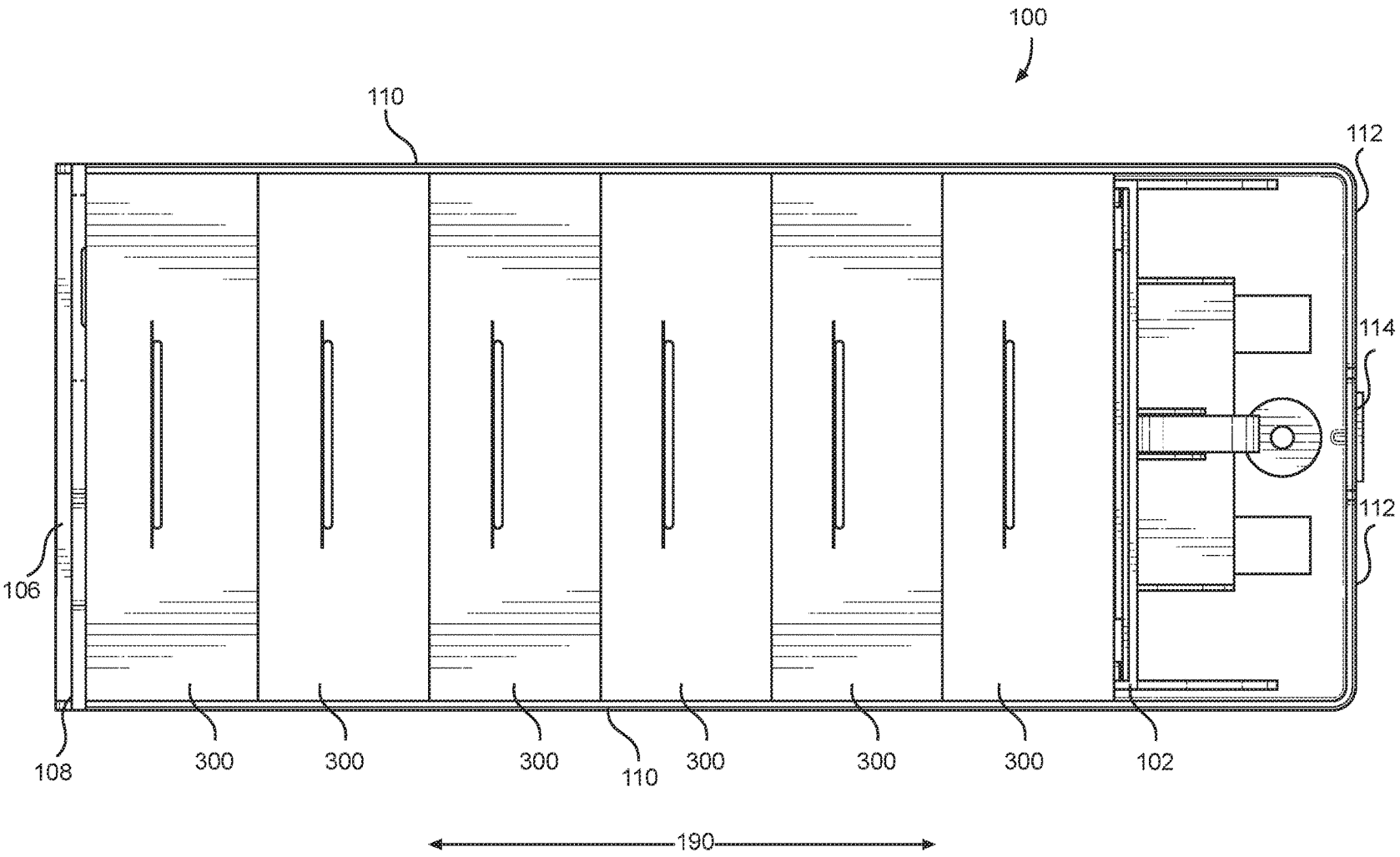
FIG. 18 illustrates a top view of the product display pusher system of FIG. 1 with product arranged for display.
Figure 19:
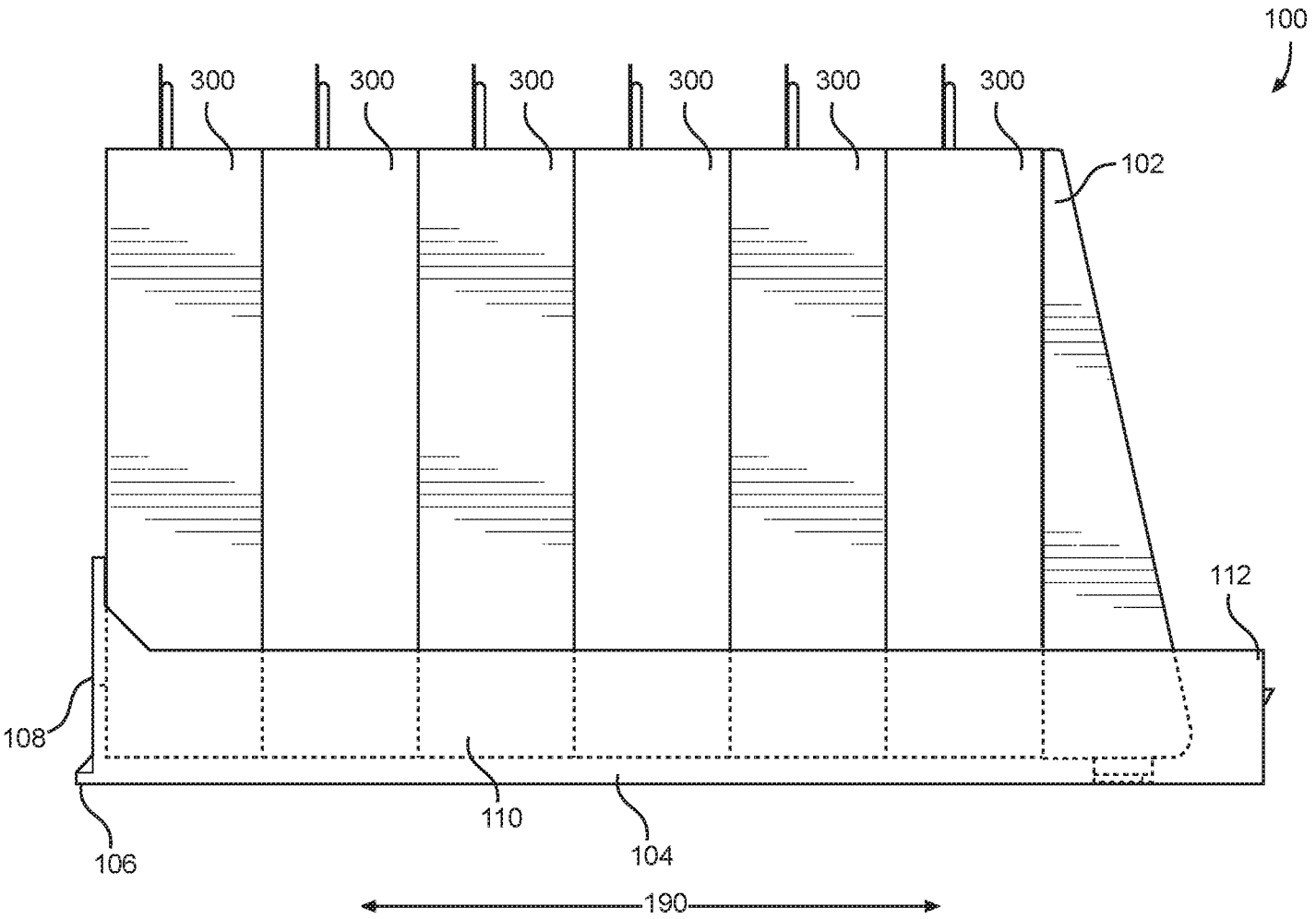
FIG. 19 illustrates a side view of the product display pusher system of FIG. 1 with product arranged for display.

FIG. 16 illustrates a front perspective view of the product display pusher system of FIG. 1 with product arranged for display; FIG. 17 illustrates a back perspective view of the product display pusher system of FIG. 1 with product arranged for display; FIG. 18 illustrates a top view of the product display pusher system of FIG. 1 with product arranged for display; and FIG. 19 illustrates a side view of the product display pusher system of FIG. 1 with product arranged for display. In particular, as shown in FIGS. 16-19, six products 300 are arranged in the pusher tray assembly 100. Of course, any number of products 300 may be arranged in the pusher tray assembly 100. The particular number of products 300 is merely exemplary. With the products 300 arranged in the pusher tray assembly 100, the pusher paddle 102 is moved in the direction of arrow 190 toward the back wall 112. This movement of the pusher paddle 102 may extend a portion of the spring 140, which is attached to an area adjacent the front wall 108. The extension of this portion of the spring 140 generates a force applied to the pusher paddle 102. This force applied to the pusher paddle 102 urges the pusher paddle 102 in the direction of arrow 190 toward the front wall 108. In this regard, if the consumer takes one of the products 300 from the pusher tray assembly 100, leaving an open space in the pusher tray 104 at a location adjacent the front wall 108, the pusher paddle 102 may be urged by the spring 140 to move in the direction of arrow 190 toward the front wall 108 to advance the remaining product 300 forwardly toward the front wall 108. Accordingly, the pusher tray assembly 100 may always have a product 300 located adjacent the front wall 108. Removing additional of the product 300 may continue the movement of the pusher paddle 102 toward the front wall 108.

Additionally, the products 300 may be large. Large as defined herein is having one or more of a width, height, or thickness that is greater than an average width, height, or thickness of typical products. Additionally, the products 300 may be heavy. Heavy as defined herein is having a weight that is greater than an average weight of typical products. In one aspect, the width of the product may be greater than 6.7 inches. In one aspect, the height of the product may be greater than 9 inches. In one aspect of the thickness of the product may be greater than 2 inches.

One or more of the various components of the pusher tray assembly 100 may be molded as a single component. In one aspect, various components of the pusher tray assembly 100 may be molded as a single component utilizing injection molding. In one aspect, various components of the pusher tray assembly 100 may be molded as a single component utilizing plastic injection molding. In one aspect, various components of the pusher tray assembly 100 may be molded as a single component utilizing copolymer plastic injection molding. In one aspect, various components of the pusher tray assembly 100 may be molded as a single component utilizing a clear impact modified material known as MARVALOY™ by injection molding (supplied by MARVAL INDUSTRIES, INC. 315 Hoyt Ave., Mamaroneck, N.Y. 10543).

In one aspect, the various components that may be molded as a single component may include one or more of the pusher tray 104, sidewalls 110, back walls 112, snap assembly 114, secondary attachment portion 118, channels 122, rails 124, front wall 108, locking feature 106, and the like. In one aspect, the various components that may be molded as a single component may include at least the pusher tray 104, sidewalls 110, back walls 112, snap assembly 114, secondary attachment portion 118, channels 122, rails 124, front wall 108, locking feature 106, and the like. In one aspect, the various components that may be molded as a single component may include the pusher paddle 102.

Relative terms such as "below" or "above" or "upper" or "lower" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The many features and advantages of the disclosure are apparent from the detailed specification, and, thus, it is intended by the appended claims to cover all such features and advantages of the disclosure, which fall within the true spirit, and scope of the disclosure. Further, since numerous modifications and variations will readily occur to those skilled in the art, it is not desired to limit the disclosure to the exact construction and operation illustrated and described, and, accordingly, all suitable modifications and equivalents may be resorted to that fall within the scope of the disclosure,

What is claimed is:

1. A pusher tray assembly configured to hold product comprising:

a pusher tray including a floor configured to hold the product thereon;

the pusher tray including a front wall, at least one sidewall, and at least one back wall;

a pusher paddle having a front face and a back face and the pusher paddle configured to move generally horizontally across the floor;

a plurality of engagement mechanisms arranged on a lower side of the pusher paddle and configured to secure the pusher paddle to the floor;

a plurality of channels arranged in the floor and each of the plurality of channels configured to receive one of the plurality of engagement mechanisms, a portion of the plurality of engagement mechanisms extending through each of the plurality of channels below the floor;

a locking feature arranged on the front wall of the pusher tray, the locking feature configured to lock the pusher tray to a shelf and prevent movement of the pusher tray;

a clear paddle graphic cover; and the front face of the pusher paddle configured to receive and hold a paddle graphic portion and the clear paddle graphic cover.

2. The pusher tray assembly according to claim 1 further comprising:

raised rails integrated into the floor, the raised rails configured to directly support a bottom surface of the product and provide reduced friction between the product and the floor; and a plurality of insertion slots associated with the plurality of channels, the plurality of insertion slots configured to receive the plurality of engagement mechanisms therethrough.

3. The pusher tray assembly according to claim 1 further comprising:

a window portion arranged in the front wall, the window portion configured to increase access to the product;

a graphic holder configured to receive a graphic therein; and the graphic holder being arranged on the front wall adjacent the window portion, wherein the locking feature extends horizontally from the front wall.

4. The pusher tray assembly according to claim 1 further comprising:

a window portion arranged in the front wall, the window portion configured to increase access to the product;

raised rails integrated into the floor, the raised rails configured to directly support a bottom surface of the product and provide reduced friction between the product and the floor;

a plurality of fins arranged on and extending from at least one side face and the back face of the pusher paddle, the plurality of fins including a bottom edge configured to engage an upper surface of the floor, the bottom edge including a curved portion configured to smooth a movement of the pusher paddle; and the paddle graphic portion.

5. The pusher tray assembly according to claim 1 further comprising:

a plurality of fins arranged on and extending from at least one side face and the back face of the pusher paddle and configured to engage the floor, the plurality of fins being arranged on opposing sides of the pusher paddle with the front face and the back face of the pusher paddle arranged therebetween, wherein the plurality of fins are configured to stabilize the pusher paddle; and wherein the locking feature extends horizontally from the front wall.

6. The pusher tray assembly according to claim 1 further comprising:

raised rails integrated into the floor, the raised rails configured to directly support a bottom surface of the product and provide reduced friction between the product and the floor;

a snap assembly extending vertically from the floor, the snap assembly configured to secure the pusher tray to a corresponding feature on the shelf; and a secondary attachment portion arranged in the floor, the secondary attachment portion configured to receive a fastener to fasten the pusher tray to the shelf.

7. The pusher tray assembly according to claim 1 further comprising:

a spring configured to urge the pusher paddle towards the front wall, wherein the plurality of engagement mechanisms are configured to stabilize the pusher paddle.

8. The pusher tray assembly according to claim 7 further comprising:

a plurality of fins arranged on and extending from at least one side face and the back face of the pusher paddle, the plurality of fins including a bottom edge configured to engage an upper surface of the floor, the bottom edge including a curved portion configured to smooth a movement of the pusher paddle;

raised rails integrated into the floor, the raised rails configured to directly support a bottom surface of the product and provide reduced friction between the product and the floor; and the spring comprises a flat coiled spring.

9. The pusher tray assembly according to claim 7 further comprising:

raised rails integrated into the floor, the raised rails configured to directly support a bottom surface of the product and provide reduced friction between the product and the floor, wherein the spring is configured to be partially held by the pusher paddle and also connected to the pusher tray.

10. The pusher tray assembly according to claim 7 further comprising:

a window portion arranged in the front wall, the window portion configured to increase access to the product;

raised rails integrated into the floor, the raised rails configured to directly support a bottom surface of the product and provide reduced friction between the product and the floor;

a plurality of insertion slots associated with the plurality of channels, the plurality of insertion slots configured to receive the at least one of the plurality of engagement mechanisms therethrough;

a graphic holder configured to receive a graphic therein; and the graphic holder being arranged on the front wall, wherein the spring comprises a flat coiled spring; and wherein the spring is configured to be partially held by the pusher paddle and also connected to the pusher tray.

11. A pusher tray assembly configured to hold product comprising:

a pusher tray including a floor configured to hold the product thereon;

the pusher tray including a front wall, at least one sidewall, and at least one back wall;

a pusher paddle having a front face and a back face and the pusher paddle configured to move generally horizontally across the floor;

a plurality of engagement mechanisms arranged on a lower side of the pusher paddle and configured to secure the pusher paddle to the floor;

a plurality of channels arranged in the floor and each of the plurality of channels configured to receive one of the plurality of engagement mechanisms, a portion of the plurality of engagement mechanisms extending through each of the plurality of channels below the floor;

a window portion arranged in the front wall, the window portion configured to increase access to the product;

a graphic holder comprising a slot arranged in the front wall and configured to receive a graphic; and a paddle graphic portion and a plurality of tabs arranged on the pusher paddle, the pusher paddle being configured to securely hold the paddle graphic portion on the front face of the pusher paddle with the plurality of tabs.

12. The pusher tray assembly according to claim 11 further comprising:

a spring configured to urge the pusher paddle towards the front wall, wherein the plurality of engagement mechanisms are configured to stabilize the pusher paddle; and wherein the spring is configured to be partially held by the pusher paddle and also connected to the pusher tray.

13. The pusher tray assembly according to claim 12 further comprising:

a plurality of fins arranged on and extending from at least one side face and the back face of the pusher paddle and configured to engage the floor, the plurality of fins being arranged on opposing sides of the pusher paddle with the front face and the back face of the pusher paddle arranged therebetween, wherein the plurality of fins are configured to stabilize the pusher paddle.

14. The pusher tray assembly according to claim 11 further comprising:

raised rails integrated into the floor, the raised rails configured to directly support a bottom surface of the product and provide reduced friction between the product and the floor;

a snap assembly extending vertically from the floor, the snap assembly configured to secure the pusher tray to a corresponding feature on a shelf; and a secondary attachment portion arranged in the floor, the secondary attachment portion configured to receive a fastener to fasten the pusher tray to the shelf.

15. A pusher tray assembly configured to hold product comprising:

a pusher tray including a floor configured to hold the product thereon;

the pusher tray including a front wall, at least one sidewall, and at least one back wall;

a pusher paddle having a front face and a back face and the pusher paddle configured to move generally horizontally across the floor;

at least one engagement mechanism arranged on a lower side of the pusher paddle and configured to secure the pusher paddle to the floor;

a spring configured to urge the pusher paddle towards the front wall;

a plurality of fins arranged on and extending from at least one side face and the back face of the pusher paddle and configured to engage the floor, the plurality of fins being arranged on opposing sides of the pusher paddle with the front face and the back face of the pusher paddle arranged therebetween;

a locking feature arranged on the front wall and the locking feature extending horizontally from the front wall, the locking feature configured to lock the pusher tray to a shelf; and a paddle graphic portion and a plurality of tabs arranged on the pusher paddle, the pusher paddle being configured to securely hold the paddle graphic portion on the front face of the pusher paddle with the plurality of tabs.

16. The pusher tray assembly according to claim 15 further comprising:

at least one channel arranged in the floor and configured to receive the at least one engagement mechanism, wherein the plurality of fins are configured to stabilize the pusher paddle.

17. The pusher tray assembly according to claim 16 further comprising:

a snap assembly extending vertically from the floor, the snap assembly configured to secure the pusher tray to a corresponding feature on the shelf;

a secondary attachment portion arranged in the floor, the secondary attachment portion configured to receive a fastener to fasten the pusher tray to the shelf, wherein the locking feature is configured to prevent movement of the pusher tray;

raised rails integrated into the floor, the raised rails configured to directly support a bottom surface of the product and provide reduced friction between the product and the floor;

a window portion arranged in the front wall, the window portion configured to increase access to the product; and a paddle graphic portion, the pusher paddle being configured to hold the paddle graphic portion on the front face of the pusher paddle.

18. The pusher tray assembly according to claim 16 further comprising:

raised rails integrated into the floor, the raised rails configured to directly support a bottom surface of the product and provide reduced friction between the product and the floor; and at least one insertion slot associated with the at least one channel, the at least one insertion slot configured to receive the at least one engagement mechanism therethrough.

19. The pusher tray assembly according to claim 16 further comprising:

a window portion arranged in the front wall, the window portion configured to increase access to the product;

a graphic holder configured to receive a graphic therein; and the graphic holder being arranged on the front wall adjacent the window portion.

20. The pusher tray assembly according to claim 16 further comprising:

raised rails integrated into the floor, the raised rails configured to directly support a bottom surface of the product and provide reduced friction between the product and the floor;

a paddle graphic portion;

a clear paddle graphic cover; and the front face of the pusher paddle configured to receive and hold the paddle graphic portion and the clear paddle graphic cover.

21. The pusher tray assembly according to claim 16 further comprising:

a window portion arranged in the front wall, the window portion configured to increase access to the product;

raised rails integrated into the floor, the raised rails configured to directly support a bottom surface of the product and provide reduced friction between the product and the floor;

a graphic holder configured to receive a graphic therein; and the graphic holder being arranged on the front wall, wherein the spring comprises a flat coiled spring; and wherein the spring is configured to be partially held by the pusher paddle and also connected to the pusher tray.

* * * * *